US008636609B2

(12) United States Patent
Chao et al.

(10) Patent No.: US 8,636,609 B2
(45) Date of Patent: Jan. 28, 2014

(54) GOLF CLUB HEAD HAVING DENT RESISTANT THIN CROWN

(75) Inventors: Bing-Ling Chao, San Diego, CA (US); Peter L. Larsen, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 249 days.

(21) Appl. No.: 11/870,913

(22) Filed: Oct. 11, 2007

(65) Prior Publication Data

US 2008/0132356 A1 Jun. 5, 2008

Related U.S. Application Data

(60) Provisional application No. 60/872,130, filed on Nov. 30, 2006.

(51) Int. Cl.
*A63B 53/00* (2006.01)

(52) U.S. Cl.
USPC ..... 473/349; 473/345; 473/324

(58) Field of Classification Search
USPC ..... 473/350, 324, 345, 349
See application file for complete search history.

(56) References Cited

U.S. PATENT DOCUMENTS

| | | | | |
|---|---|---|---|---|
| 6,402,639 | B1 * | 6/2002 | Iwata et al. | 473/330 |
| 7,153,221 | B2 | 12/2006 | Hocknell | |
| 7,186,179 | B1 | 3/2007 | Anderson | |
| 7,258,625 | B2 | 8/2007 | Kawaguchi et al. | |
| 7,396,297 | B2 * | 7/2008 | Hirano | 473/345 |
| 7,445,564 | B2 * | 11/2008 | Kusumoto | 473/346 |
| 7,559,853 | B2 * | 7/2009 | Hirano | 473/324 |
| 2003/0036442 | A1 | 2/2003 | Chao | |
| 2005/0159245 | A1 | 7/2005 | Chen | |
| 2005/0245328 | A1 * | 11/2005 | Kouno et al. | 473/345 |
| 2005/0261082 | A1 * | 11/2005 | Yamamoto | 473/345 |
| 2005/0288124 | A1 * | 12/2005 | Galloway et al. | 473/345 |
| 2006/0079349 | A1 * | 4/2006 | Rae et al. | 473/345 |
| 2006/0084525 | A1 * | 4/2006 | Imamoto et al. | 473/345 |
| 2006/0089207 | A1 * | 4/2006 | Galloway et al. | 473/345 |
| 2006/0100031 | A1 * | 5/2006 | Lan | 473/345 |
| 2006/0172818 | A1 | 8/2006 | Yamamoto | |

(Continued)

FOREIGN PATENT DOCUMENTS

| | | |
|---|---|---|
| JP | 2003-019233 | 1/2003 |
| JP | 2005-312942 | 11/2005 |
| JP | 2006-075594 | 3/2006 |
| JP | 2006-204604 | 8/2006 |
| JP | 2006-314628 | 11/2006 |

OTHER PUBLICATIONS

"Exhibit 1", Aug. 30, 2010, Excel Spreadsheet, 1 page.*
Stanczak, Exhibit 1, Sep. 7, 2011, Excel Spreadsheet, 1.*
Office Action for related Japanese Patent Application No. 2007-310356, 3 pages, Jan. 21, 2010.
Office Action for related Japanese Patent Application No. 2010-163681, 4 pages, Mar. 26, 2012.
Office Action for related Japanese Patent Application No. 2010-163681, 4 pages, Nov. 1, 2012.

*Primary Examiner* — Gene Kim
*Assistant Examiner* — Matthew B Stanczak
(74) *Attorney, Agent, or Firm* — Klarquist Sparkman, LLP

(57) ABSTRACT

Wood-type golf club heads have dent resistant crowns with surface areas configured so that at least about 50% of the crown surface area is associated with a crown thickness substantially equivalent to a critical thickness. A critical thickness is generally associated with a higher dent resistance than crowns that are substantially thinner or thicker. Wood-type golf club heads also have crowns with radii and spans that are substantially equivalent to critical crown radii and critical crown spans. Such wood-type golf club heads also exhibit surprisingly superior dent resistance than would be expected for a crown of such thickness.

11 Claims, 11 Drawing Sheets

(56) References Cited

U.S. PATENT DOCUMENTS

| | | | | |
|---|---|---|---|---|
| 2006/0172820 | A1* | 8/2006 | Kouno et al. | 473/345 |
| 2006/0223653 | A1 | 10/2006 | Iizuka | |
| 2006/0258481 | A1* | 11/2006 | Oyama | 473/345 |
| 2006/0287131 | A1* | 12/2006 | Hirano | 473/345 |
| 2006/0287132 | A1* | 12/2006 | Meyer et al. | 473/345 |
| 2007/0004531 | A1* | 1/2007 | Galloway et al. | 473/334 |
| 2007/0010347 | A1* | 1/2007 | Galloway et al. | 473/334 |
| 2007/0026962 | A1* | 2/2007 | Galloway et al. | 473/329 |
| 2007/0049404 | A1* | 3/2007 | Chen | 473/345 |
| 2007/0060414 | A1* | 3/2007 | Breier et al. | 473/350 |
| 2007/0105657 | A1* | 5/2007 | Hirano | 473/345 |
| 2007/0117652 | A1* | 5/2007 | Beach et al. | 473/349 |

* cited by examiner

Crown Thickness = 0.57 mm

Crown Thickness = 0.58 mm

Crown Thickness = 0.57 mm

Crown Thickness = 0.58 mm

GOLF CLUB HEAD HAVING DENT RESISTANT THIN CROWN

CROSS REFERENCE TO RELATED APPLICATION

This application claims the benefit of U.S. Provisional Application No. 60/872,130, filed Nov. 30, 2006, which is incorporated herein by reference.

FIELD

This application pertains to wood-type golf clubs.

BACKGROUND

Various golf club head performance parameters such as the location of the center of gravity (CG) and the magnitudes of moments of inertia are related to the distribution of mass within the club head. Mass in the form of material not required to maintain structural integrity of the club head, i.e., discretionary mass, may be redistributed within the club head to enhance these performance parameters, thereby increasing golf club performance. Greater discretionary mass allows golf club designers more leeway in distributing the total club head mass to achieve particular golf club head performance characteristics. Consequently, increasing the amount of discretionary mass available for redistribution is desirable.

A wood-type (i.e., driver or fairway wood) golf club head includes a hollow body delineated by a crown, a sole, a skirt, and a striking plate. Designers of wood-type club heads have implemented various methodologies to provide greater discretionary mass in their products. For example, current wood-type club heads are typically formed of steel alloys, titanium alloys, and/or composites. These materials have relatively high strength/weight ratios, and as a result may be used to form thin club head walls. Among other advantages, thin wall construction typically provides for greater discretionary mass.

Reducing the thickness of the crown could reduce the mass of the crown so as to provide additional mass that could be redistributed as discretionary mass to other portions of the driver head. However, reducing the thickness of the crown is seemingly problematic in that it makes the crown more susceptible to damage (e.g., denting) when the crown is struck by an object such as another golf club in a golf bag. Crown dents are cosmetically undesirable, and may also create structural problems due to fatigue failures and cracking.

It should, therefore, be appreciated that there is a need for wood-type golf club heads having reduced crown thickness to provide for increased discretionary mass without sacrificing dent resistance.

SUMMARY

Representative embodiments of a wood-type golf club head comprise a crown having a surface area configured so that at least about 50% of the crown surface area is associated with a crown thickness substantially equivalent to a critical thickness. In some examples, the critical thickness is between about 0.5 mm and about 0.8 mm. In other examples the critical thickness is less than about 0.65 mm. In other examples, the critical thickness is greater than about 0.59 mm. In other examples, the critical thickness is less than about 0.62 mm. In other examples, the critical thickness is less than about 0.60 mm. In additional examples, the crown has a radius of curvature and a span configured so that the crown exhibits an average deformation area that is less that about 0.3% of the crown surface area when subjected to an impact test. In some examples, the average deformation area is less than about 0.1% of the crown surface area when subjected to the impact test. In other examples, the crown has a front-to-back radius of curvature between about 60 mm and about 120 mm and a heel-to-toe radius of curvature between about 60 mm and about 120 mm. In other examples, the front-to-back radius of curvature is between about 70 mm and about 110 mm and the heel-to-toe radius of curvature is between about 70 mm and about 110 mm. In other examples, the front-to-back radius of curvature is between about 80 mm and about 100 mm and the heel-to-toe radius of curvature is between about 80 mm and about 100 mm.

In further examples, the crown has an equivalent crown span of between about 90 mm and about 120 mm. In some examples, the equivalent crown span is between about 95 mm and about 110 mm. In other examples, the equivalent crown span is between about 100 mm and about 105 mm. In some examples, the crown has a modulus of elasticity between about 10 Msi and about 25 Msi. In other examples, the crown is formed from a metallic material.

Another representative embodiment of a wood-type golf club head comprises a striking plate positioned at a front portion of the golf club head and an impact resistant crown secured to the striking plate and positioned at an upper portion of the golf club head. At least about 50% of the impact resistant crown has a thickness less than about 0.8 mm and a golf club head center of gravity is located below a plane passing through a golf club head origin positioned at an approximate geometric center of the striking plate and substantially parallel to the ground when the head is at address position. In some examples, the golf club head center of gravity is located between about 2 mm and about 8 mm below the plane passing through the golf club head origin. In additional examples, the impact resistant crown has a thickness such that when subjected to a ball drop test, an average permanent crown deformation has a surface area less than about 0.5% of a crown surface area. In some examples, at least about 60% of the impact resistant crown has a thickness of less than about 0.65 mm.

In additional examples, the golf club head further comprises a sole positioned at a bottom portion of the golf club head and a skirt positioned around a periphery of the golf club head between the sole and the impact resistant crown. The crown, skirt, striking plate, and sole define a club head volume. The golf club head has a total mass between about 150 grams and 300 grams and the club head volume is between about 300 $cm^3$ and 500 $cm^3$. In some examples, the golf club head has a total mass between about 190 grams and about 210 grams and the club head volume is between about 350 $cm^3$ and about 460 cm . In other examples, at least about 50% of the skirt has a thickness of between about 0.65 mm and about 0.8 mm. In other examples, a front-to-back radius of curvature of the crown, a heel-to-toe radius of curvature of the crown, and a crown span are configured so that the club head volume is substantially a critical crown volume.

In additional examples, at least about 50% of the sole has a thickness between about 0.85 mm and about 1.1 mm. In some examples, at least about 55% of the sole has a thickness between about 0.85 mm and about 1.1 mm. In other examples, at least about 60% of the sole has a thickness between about 0.85 mm and about 1.1 mm. In other examples, at least about 70% of the impact resistant crown has a thickness less than about 0.62 mm. In further examples, at least about 80% of the impact resistant crown has a thickness less than about 0.62 mm. In some examples, a moment of inertia about a club head center of gravity z-axis generally perpendicular to the ground when the club head is at address is greater than about 500 kg·mm$^2$.

Another embodiment of a wood-type golf club head comprises a crown positioned at an upper portion of the golf club head. At least about 50% of the crown has a thickness less than about 0.65 mm and exhibits an average permanent crown deformation having an area less than about 0.7% of a crown surface area in response to a ball drop test. In some examples, the crown has a surface area between about 8000 mm$^2$ and about 11000 mm$^2$. In other examples, the crown has a surface area between about 8800 mm$^2$ and about 92000 mm$^2$. In additional examples, the average permanent crown deformation area in response to an impact test is less than about 0.5% of the crown surface area. In further examples, the average permanent crown deformation area is less than about 0.3% of the crown surface area. In other examples, at least about 50% of the crown has a thickness less than about 0.62 mm. In some examples, at least about 50% of the crown has a thickness less than about 0.60 mm.

In additional examples, a moment of inertia about a club head center of gravity z-axis generally perpendicular to the ground with the club head at an address position is between about 400 kg·mm$^2$ and about 700 kg·mm$^2$. In other examples, the moment of inertia about the club head center of gravity z-axis is between about 500 kg·mm$^2$ and about 600 kg·mm$^2$. In some examples, the moment of inertia about the club head center of gravity z-axis is between about 550 kg·mm$^2$ and about 600 kg·mm$^2$. In some examples, the golf club head has a head depth between about 70 mm and about 120 mm. In some examples, the golf club head has a head depth between about 90 mm and about 100 mm. In other examples, the golf club head has a head height between about 50 mm and about 80 mm. In further examples, the head height is between about 60 mm and about 70 mm. In some examples, the golf club head has a head width between about 80 mm and about 130 mm. In some examples, the head width is between about 100 mm and about 110 mm.

Another representative embodiment of a wood-type golf club head comprises a body comprising a striking plate positioned at a front portion of the golf club head, a sole positioned at a bottom portion of the golf club head, a crown positioned at an upper portion of the golf club head and a skirt positioned around a periphery of the golf club head between the sole and the crown. The body defines an interior cavity and the head has a golf club head origin positioned on the striking plate at an approximate geometric center of the striking plate. The head origin includes an x-axis tangential to the striking plate and generally parallel to the ground when the head is at address position, a y-axis generally perpendicular to the x-axis and generally parallel to the ground when the head is in address position, and a z-axis generally perpendicular to the x-axis and the y-axis. About 81% of the crown has a thickness less than about 0.60 mm and about 19% of the crown has a thickness greater than about 0.8 mm. The crown has an equivalent crown span of about 111 mm, a front-to-back radius of curvature between about 85 mm and about 90 mm, and a heel-to-toe radius of curvature between about 100 mm and about 120 mm. The skirt has a thickness between about 0.6 mm and about 1.1 mm and the sole has a thickness between about 0.8 mm and about 1.2 mm. The sole and the skirt of the golf club head are formed as a unitary body from a titanium alloy. A club head center of gravity is located below a plane defined by the head origin x-axis and the head origin y-axis and a distance delta-1 is between about 14.9 mm and about 16.8 mm. The club head has a total head mass of about 206 grams, a head volume of about 411 cm$^3$, a moment of inertia about a center of gravity x-axis generally parallel to the origin x-axis between about 219 kg mm$^2$ and about 255 kg·mm$^2$, a moment of inertia about a center of gravity z-axis generally parallel to the origin z-axis between about 384 kg·mm$^2$ and about 391 kg·mm$^2$, a head depth of about 102 mm, a head height of about 65.5 mm, and a head width of about 116 mm.

Another representative embodiment of a wood-type golf club head comprises a body comprising a striking plate positioned at a front portion of the golf club head, a sole positioned at a bottom portion of the golf club head, a crown positioned at an upper portion of the golf club head and a skirt positioned around a periphery of the golf club head between the sole and the crown. The body defines an interior cavity and the head has a golf club head origin positioned on the striking plate at an approximate geometric center of the striking plate. The head origin includes an x-axis tangential to the striking plate and generally parallel to the ground when the head is at address position, a y-axis generally perpendicular to the x-axis and generally parallel to the ground when the head is in address position, and a z-axis generally perpendicular to the x-axis and the y-axis. About 82% of the crown has a thickness less than about 0.60 mm and about 18% of the crown has a thickness greater than about 0.8 mm. The crown has an equivalent crown span of about 114 mm, a front-to-back radius of curvature of between about 85 mm and about 90 mm, and a crown heel-to-toe radius of curvature of between about 110 mm and about 120 mm. The skirt has a thickness between about 0.6 mm and about 0.9 mm and the sole has a thickness of between about 0.8 mm and about 1.1 mm. The sole and the skirt of the golf club head are formed as a unitary body from a titanium alloy and the striking plate is formed from the titanium alloy. A club head center of gravity is located below a plane defined by the head origin x-axis and the head origin y-axis and a distance delta-1 is about 18.5 mm. The club head has a total head mass of about 204 grams, a head volume of about 455 cm$^3$, a moment of inertia about a center of gravity x-axis generally parallel to the origin x-axis of about 259 kg·mm$^2$, a moment of inertia about a center of gravity z-axis generally parallel to the origin z-axis of about 416 kg·mm$^2$ to about 421 kg·mm$^2$, a head depth of about 109 mm, a head height of about 65.7 mm, and a head width of about 115 mm. Representative embodiments of a golf club head crown comprise a shaped substrate having a thickness and defining a club exterior crown surface area. The shaped substrate defines a front-to-back crown span, a toe-to-heel crown span, a crown front-to-back radius of curvature, and a crown toe-to-heel radius of curvature. The thickness is less than about 0.8 mm and the shaped substrate has a mass less than about 36 grams. The shaped substrate is configured so that an average area of a permanent crown deformation produced in an impact test is less than about 0.7% of the club exterior crown surface area. In some examples, the club exterior crown surface area is between about 8000 mm$^2$ and about 11000 mm$^2$. In other examples, the club exterior crown surface area is between about 9500 mm$^2$ and about 10500 mm$^2$. In further examples, the shaped substrate is configured so that the average area of a permanent crown deformation produced in the impact test is less than about 0.5% of the club exterior crown surface area. In additional examples, the shaped substrate is configured so that the average area of a permanent crown deformation produced in the impact test is less than about 0.3% of the club exterior crown surface area. In some examples, between about 70% and about 90% of the shaped substrate has a thickness less than about 0.62 mm. In other examples, between about 80% and about 85% of the shaped substrate has a thickness less than about 0.60 mm.

In additional examples, the shaped substrate is formed from a metallic material. In some examples, a modulus of elasticity of the shaped substrate is between about 13 Msi and about 20 Msi. In other examples, at least one of the toe-to-heel span and the front-to-back span is a critical span. In some examples, the shaped substrate has a mass less than about 30 grams. In other examples, at least one of the toe-to-heel and the front-to-back radii of curvature is a critical radius of curvature.

The foregoing and other objects, features, and advantages of the disclosed technology will become more apparent from the following detailed description, which proceeds with reference to the accompanying drawings.

DETAILED DESCRIPTION

Figure 1:
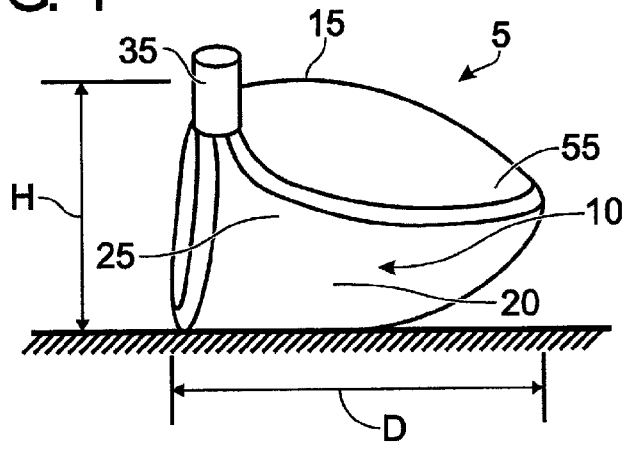
FIG. 1 is a side perspective view of a wood-type golf club head.

As used in this application and in the claims, the singular forms "a," "an," and "the" include the plural forms unless the context clearly dictates otherwise. Additionally, the term "includes" means "comprises."

The described systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

Theories of operation, scientific principles, or other theoretical descriptions presented herein in reference to the apparatus or methods of this disclosure have been provided for the purposes of better understanding and are not intended to be limiting in scope. The apparatus and methods in the appended claims are not limited to those apparatus and methods which function in the manner described by such theories of operation.

General Description

As illustrated in FIGS. 1-4, a typical wood-type (i.e., driver or fairway wood) golf club head 5 includes a hollow body 10 delineated by a crown 15, a sole 20, a skirt 25, a striking plate 30, and a hosel 35. The striking plate 30 defines a front surface or striking face 40 adapted for impacting a golf ball (not shown). The hosel 35 defines a hosel bore 37 adapted to receive a golf club shaft (not shown). The body 10 further includes a heel portion 45, a toe portion 50 and a rear portion 55. The crown 15 is defined as an upper portion of the club head 5 extending above a peripheral outline 57 of the club head as viewed from a top-down direction as normally positioned to address a golf ball and rearwards of the topmost portion of the striking face 40. The sole 20 is defined as a lower portion of the club head 5 extending in an upwardly direction from a lowest point of the club head approximately 50% to 60% of the distance from the lowest point of the club head to the crown 15. The skirt 25 is defined as a side portion of the club head 5 between the crown 15 and the sole 20 extending immediately below the peripheral outline 57 of the club head, excluding the striking face 40, from the toe portion 50, around the rear portion 55, to the heel portion 45. The club head 5 has a volume, typically measured in cubic-centimeters ($cm^3$), equal to the volumetric displacement of the club head 5.

Moments of Inertia

Figure 5:
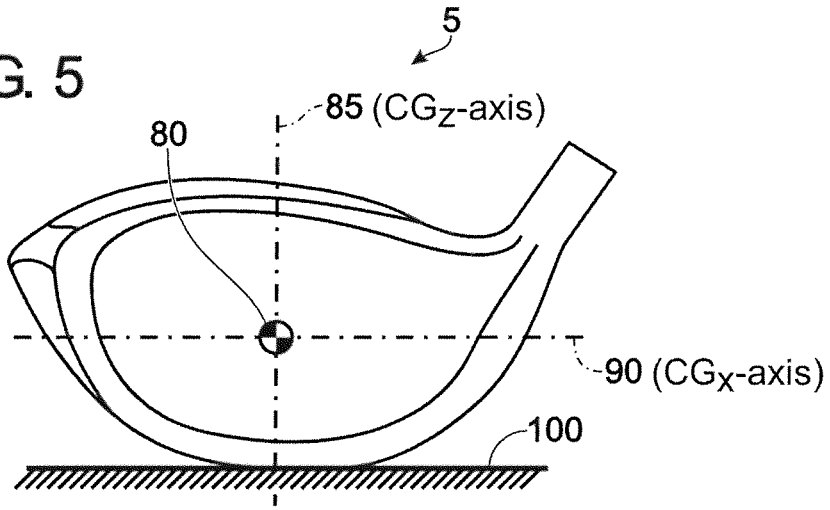
FIG. 5 is a front perspective view of a wood-type golf club head showing a golf club head center of gravity coordinate system.
Figure 6:
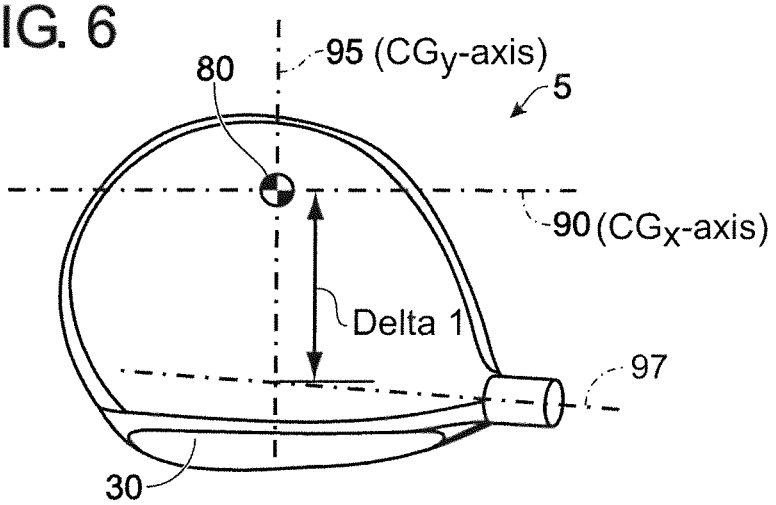
FIG. 6 is a top perspective view of a wood-type golf club head showing a golf club head center of gravity coordinate system.

Referencing FIGS. 5-6, club head moments of inertia are typically defined with respect to three axes extending through a club head center-of-gravity (CG) 80. A center-of-gravity z-axis, $CG_z$-axis, 85 extends through the CG 80 in a generally vertical direction relative to the ground 100 when the club head 5 is at address position. A center-of-gravity x-axis, $CG_x$-axis, 90 extends through the CG 80 in a heel-to-toe direction generally parallel to the striking face 40 and generally perpendicular to the $CG_z$-axis 85. A center-of-gravity y-axis, $CG_y$-axis, 95 extends through the CG 80 in a front-to-back direction and generally perpendicular to the $CG_x$-axis 90 and the $CG_z$-axis 85. The $CG_x$-axis 90 and the $CG_y$-axis 95 both extend in a generally horizontal direction relative to the ground when the club head 5 is at address position.

A moment of inertia about the $CG_x$-axis 90 ($I_{CGx}$) can be calculated by the following equation:

$$I_{CG_x}=\int(y^2+Z^2)dm \quad (1)$$

wherein y is a distance from a club head $CG_{xz}$-plane to an infinitesimal mass dm and z is a distance from a club head $CG_{xz}$-plane to the infinitesimal mass dm. The club head $CG_{xz}$-plane is a plane defined by the club head $CG_x$-axis 90 and the club head $CG_z$-axis 85. The $CG_{xy}$-plane is a plane defined by the $CG_x$-axis 90 and the golf club head $CG_y$-axis 95.

A moment of inertia about the $CG_z$-axis 85 ($I_{CGz}$) is calculated by the following equation:

$$I_{CG_z}=\int(x^2+y^2)dm \quad (2)$$

wherein x is a distance from a club head $CG_{yz}$-plane to an infinitesimal mass dm and y is the distance from the club head $CG_{xz}$-plane to the infinitesimal mass dm. The club head $CG_{yz}$-plane is a plane defined by the golf club head $CG_y$-axis 95 and the golf club head $CG_x$-axis 90.

Club Head Origin Coordinate System

Figure 7:
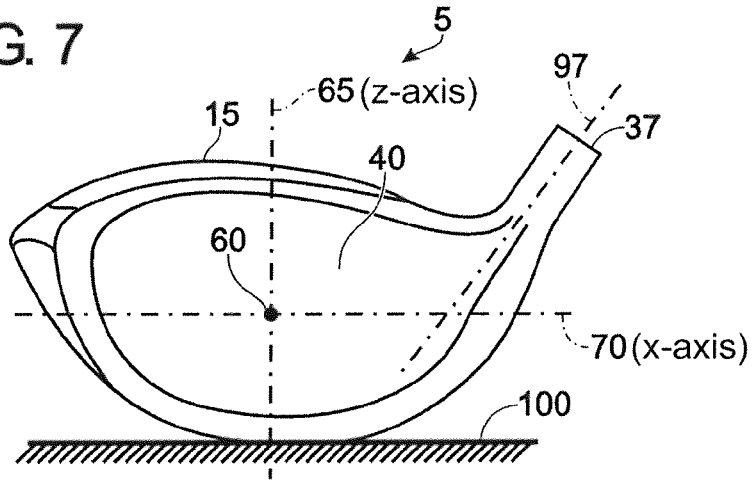
FIG. 7 is a front perspective view of a wood-type golf club head showing a golf club head origin coordinate system.
Figure 8:
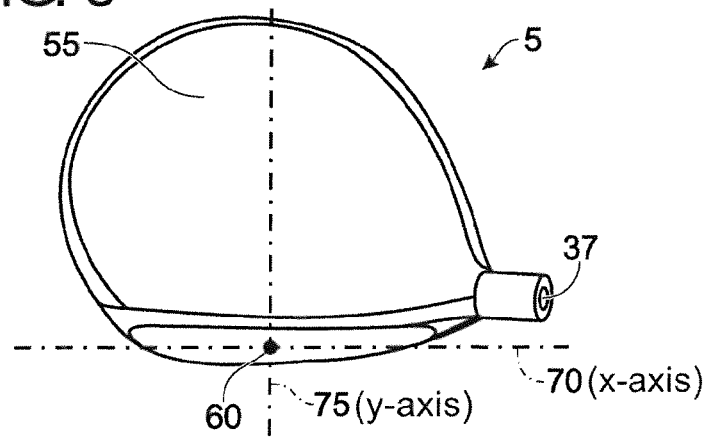
FIG. 8 is a top perspective view of a wood-type golf club head showing a golf club head origin coordinate system.

A club head origin coordinate system may be provided such that the location of various features of the club head (e.g., CG 80) can be determined. Referencing FIGS. 7-8, a club head origin 60 is represented on club head 5. The club head origin 60 is positioned substantially at a geometric center of the striking face 40 (i.e., an intersection of the midpoints of the striking face's height and width, as defined by the USGA "Procedure for Measuring the Flexibility of a Golf Clubhead," Revision 2.0).

The head origin coordinate system, with head origin 60, includes three axes: a z-axis 65 extending through the head origin 60 in a generally vertical direction relative to the ground 100 when the club head 5 is at address position; an x-axis 70 extending through the head origin 60 in a heel-to-toe direction generally parallel to the striking face 40 and generally perpendicular to the z-axis 65; and a y-axis 75 extending through the head origin 60 in a front-to-back direction and generally perpendicular to the x-axis 70 and the z-axis 65. The x-axis 70 and the y-axis 75 both extend in a generally horizontal direction relative to the ground 100 when the club head 5 is at address position. The x-axis 70 extends in a positive direction from the origin 60 to the toe 50 of the club head 5; the y-axis 75 extends in a positive direction from the origin 60 towards the rear portion 55 of the club head 5; and the z-axis 65 extends in a positive direction from the origin 60 towards the crown 15.

Delta-1 and Delta-2

The location of various features of the club head (e.g., CG 80) may also be provided relative to a shaft axis 97 extending axially through the hosel bore 37. Delta-1 is defined as a distance measured along the $CG_y$-axis 95 between the $CG_{xz}$-plane and a plane passing through the shaft axis 97 and generally parallel to the $CG_z$-axis 85. Delta-2 is defined as a distance measured along the $CG_x$-axis 90 between the $CG_{yz}$-plane and a plane passing through the shaft axis 97 and generally parallel to the $CG_y$-axis 85.

Clubhead Dimensional Definitions

Figure 2:
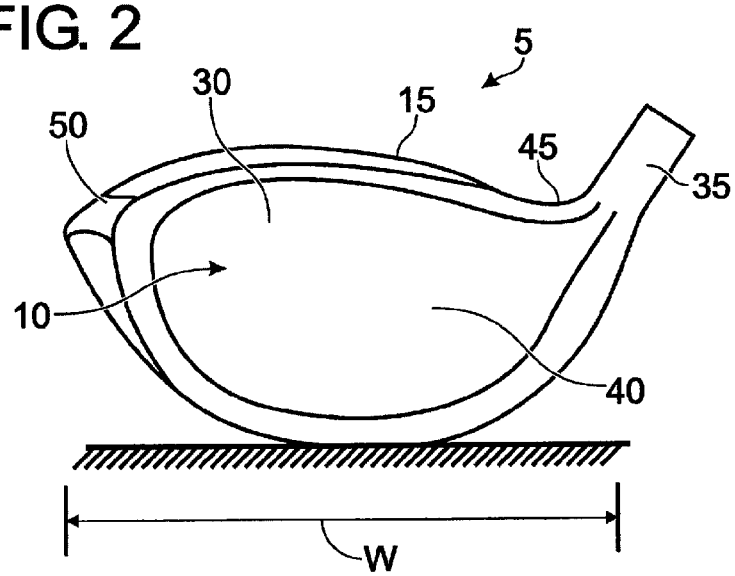
FIG. 2 is a front perspective view of a wood-type golf club head.
Figure 3:
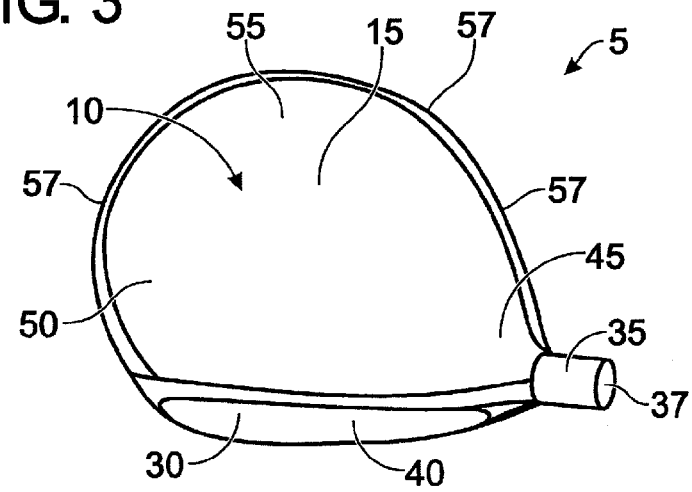
FIG. 3 is a top perspective view of a wood-type golf club head.
Figure 4:
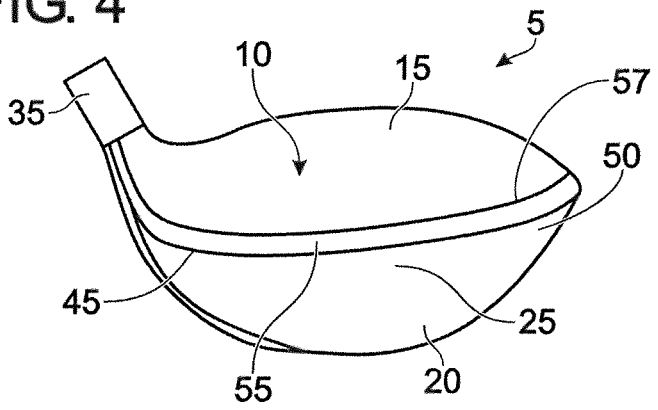
FIG. 4 is a back perspective view of a wood-type golf club head.

Referencing FIGS. 1-2, club head 5 has a maximum height (H) defined as a distance between the lowest and highest points on the surface of the body 10 measured along an axis parallel to the z-axis when the club head 5 is at address position; a maximum depth (D) defined as a distance between the forwardmost and rearmost points on the surface of the body 10 measured along an axis parallel to the y-axis when the club head 5 is at address position; and a maximum width (W) defined as a distance between the maximum extents of the toe 50 and heel 45 portions of the body measured along an axis parallel to the x-axis when the club head 5 is at address position.

Impact Analyses Introduction

For a high volume wood-type golf club head, it is normally desirable to locate the center of gravity of the club head below the geometric center of a striking face (i.e., the intersection of the midpoints of a striking face's height and width, as defined by the USGA "Procedure for Measuring the Flexibility of a Golf Clubhead," Revision 2.0). Reducing the thickness of the crown results in increased discretionary mass that may be redistributed to lower the center of gravity of the club head. For example, for a 460 $cm^3$ driver head formed from a titanium alloy with a crown area of approximately 100 $cm^2$, a crown with a thickness on the order of about 0.8 mm typically has a mass on the order of about 36 grams. Reducing the thickness of the crown by about 0.2 mm could reduce the mass of the crown by approximately 9.0 grams, which could then be redistributed in the form of discretionary mass to other portions of the driver head.

Unfortunately, it is typically undesirable to reduce the thickness of the crown because thinner crowns are typically more susceptible to permanent deformations, such as denting, when the crown is struck by an object such as by a moving ball or another golf club in a golf bag. Crown dents are cosmetically undesirable and may also create structural problems due to fatigue failures and cracking.

Numerical simulations and experimental testing may be used to analyze impact phenomenon and the effect that varying club head parameters such as crown thickness has on such deformations. Theoretical simulations and experimental tests described herein are based on various golf club head configurations. The golf club head configurations include golf club heads typically formed from metallic materials and with a variety of club head geometries and material properties. Theoretical and experimental data are described wherein certain types of thin golf club crowns demonstrate unexpected resistance to denting and other permanent crown deformations when compared with similar, thicker crowns. Surprisingly, golf club crowns can be substantially thinner than the crowns of conventional wood-type club heads without sacrificing damage resistance.

Theoretical/Numerical Impact Analyses

Figure 9:
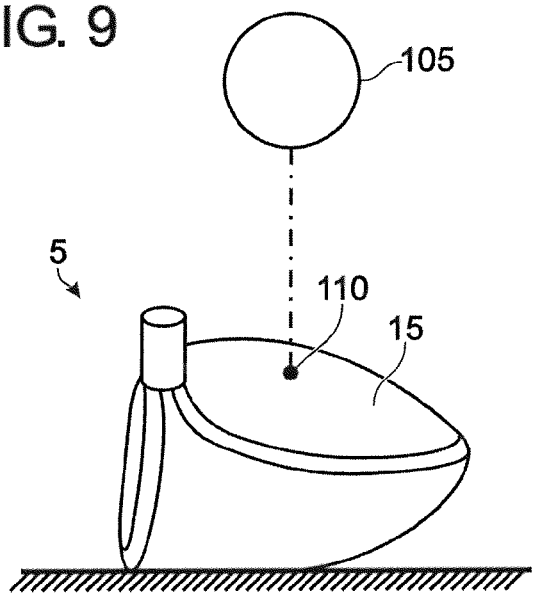
FIG. 9 is a side perspective view of a wood-type golf club head and a blunt indenter.

Referencing FIG. 9, when a crown 15 of a wood-type golf head 5 is struck by a moving object 105 (or alternatively when a moving wood-type golf head strikes another moving or motionless object) at a crown impact location 110, local deformation around the crown impact location occurs. Such situations can be generically associated with so-called dynamic loading. Unlike static loading, during dynamic loading not all of the impact energy is typically transferred into crown deformation. During dynamic loading, impact energy may also generate stress waves (such as surface, compressive, transverse, and shear waves) that pass through the crown 15. The deformation energy that results in local deformation around the crown impact location 110 is typically in the form of compressive and shear waves, which constitute only a portion of the total impact energy. Typically a crown impacted by an object such as, for example, a steel ball or another golf club head experiences both elastic and plastic deformations. Portions of the crown that experience elastic deformations tend to return to essentially their original form following impact. Plastic deformations are generally permanent crown deformations that remain after impact. In some examples, permanent crown deformations are referred to as dents.

Figure 10:
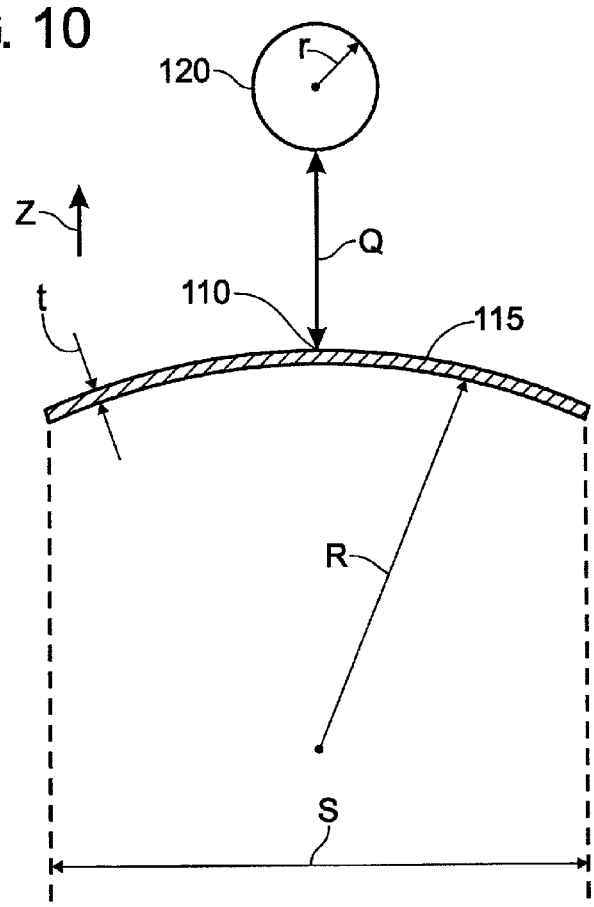
FIG. 10 is a cross-sectional view of a portion of a golf club head crown and a blunt indenter.

FIG. 10 is a cross-sectional view of a portion of a golf club head crown 115 and a blunt indenter 120. ABAQUS software from ABAQUS, Inc. was used to simulate the impact of the blunt indenter 120 on the golf club head crown 115 at impact location 110. Using shell elements, the crown 115 was numerically modeled as a convex bowl. Base model conditions for the crown 115 included a crown thickness (t) of 0.8 mm, a crown radius of curvature (R) of 127 mm, and a crown span (S) of 90 mm. Base model conditions for the crown material included a yield strength of 130 Ksi, a modulus of elasticity of 15.6 Msi, and a strain hardening coefficient (n) of 0.047, all of which are typical of the Ti-6Al-4V alloy commonly used to cast wood-type golf club heads. The blunt indenter 120 was modeled as a rigid surface sphere. Base model conditions for the blunt indenter 120 included an indenter radius (r) of 24.1 mm and an indenter density of about 7.8 g/cm$^3$, which is approximately the density of many common steel alloys. The base model indenter drop height (Q) (i.e., the distance between the blunt indenter 120 and the crown impact location 110) for the simulation was set at 1350 mm.

The stress-strain relationship for the crown 115 beyond yielding was modeled using the following equation:

$$\sigma=153\ \epsilon^{0.047}(\text{Ksi}), \tag{3}$$

wherein $\sigma$ represents stress, $\epsilon$ represents strain, and the strength coefficient is 153.

Several different simulations of a rigid indenter impacting a shell-type crown were performed by varying different parameters of the indenter and by varying different parameters of the crown relating to the crown geometry and to the crown material properties. Specifically, crown radius of curvature ($R_c$), crown span (S), crown thickness ($t_c$), indenter radius (r), indenter drop height (Q), crown material yield strength, and crown material modulus of elasticity were each varied independently while the remaining parameters remained at base model conditions. The results of several numerical simulations are summarized in Tables 1-6. In Tables 1-6, theoretical crown deformation ($D_c$) is defined as a maximum residual deflection (i.e., dent depth) of a single node at the crown impact location 110 after impact. The dent depth characterizes the permanent deformation of the club head crown resulting from impact. Large theoretical deformation values are generally indicative of an instability condition, such as buckling, which will be described in greater detail below.

TABLE 1

Theoretical crown deformation ($D_c$) as a function of crown radius of curvature ($R_c$) for a 0.8 mm thick crown with a crown span of 90 mm and crown material having a yield strength of 130 Ksi and a modulus of elasticity of 15.6 Msi. Indenter radius (r) and indenter drop height (Q) are 24.1 mm and 1350 mm, respectively.

| | | | |
|---|---|---|---|
| Crown Radius of Curvature ($R_c$) | 76.2 mm | 127 mm | 177.8 mm |
| Theoretical Crown Deformation ($D_c$) | 4.0 mm | 0.63 mm | 0.53 mm |

TABLE 2

Theoretical crown deformation ($D_c$) as a function of crown span (S) for a 0.8 mm thick crown with a crown radius of curvature of 127 mm and crown material having a yield of strength of 130 Ksi and a modulus of elasticity of 15.6 Msi. Indenter radius (r) and drop height (Q) are 24.1 mm and 1350 mm, respectively.

| | | | |
|---|---|---|---|
| Crown Span (S) | 60 mm | 90 mm | 120 mm |
| Theoretical Crown Deformation ($D_c$) | 6.6 mm | 0.63 mm | 0.54 mm |

TABLE 3

Theoretical crown deformation ($D_c$) as a function of crown thickness ($t_c$) for a crown with a crown span of 90 mm, a crown radius of curvature of 127 mm, and crown material having a yield strength of 130 Ksi and a modulus of elasticity of 15.6 Msi. Indenter radius (r) and indenter drop height (Q) are 24.1 mm and 1350 mm, respectively.

| | | | | | | | |
|---|---|---|---|---|---|---|---|
| $t_c$ (mm) | 0.5 | 0.55 | 0.6 | 0.7 | 0.8 | 0.9 | 1.0 |
| $D_c$ (mm) | 11.0 | 9.57 | 0.53 | 0.49 | 0.63 | 1.1 | 1.6 |

TABLE 4

Theoretical crown deformation ($D_c$) as a function of indenter radius (r) for a 0.8 mm thick crown with a 90 mm crown span, a radius of curvature of 127 mm, and crown material having a yield strength of 130 Ksi and modulus of elasticity of 15.6 Msi. Indenter drop height (Q) is 1350 mm.

| | | | | | | |
|---|---|---|---|---|---|---|
| r (mm) | 17.8 | 20.3 | 22.9 | 24.1 | 25.4 | 27.9 |
| $D_c$ (mm) | 0.87 | 0.77 | 0.67 | 0.63 | 0.58 | 0.5 |

TABLE 5

Theoretical crown deformation ($D_c$) as a function of indenter drop height (Q) for a 0.8 mm thick crown with a 90 mm crown span, a radius of curvature of 127 mm, and crown material having a yield strength of 130 Ksi and modulus of elasticity of 15.6 Msi. Indenter radius (r) is 24.1 mm.

| | | | | | | |
|---|---|---|---|---|---|---|
| Indenter Drop Height (Q) (mm) | 1000 | 1250 | 1350 | 1500 | 1750 | 2000 |
| $D_c$ (mm) | 0.62 | 0.62 | 0.63 | 0.64 | 0.66 | 0.69 |

TABLE 6

Theoretical crown deformation ($D_c$) as a function of crown material yield strength and modulus of elasticity for a 0.8 mm thick crown with a 90 mm crown span and a radius of curvature of 127 mm. Indenter drop height (Q) and indenter radius (r) are 1350 mm and 24.1 mm, respectively.

| | | | | |
|---|---|---|---|---|
| Yield Strength | 130 Ksi | 125 Ksi | 130 Ksi | 125 Ksi |
| Modulus of Elasticity | 15.6 Msi | 15.6 Msi | 13.9 Msi | 13.9 Msi |
| $D_c$ (mm) | 0.63 | 0.76 | 0.46 | 0.50 |

The numerical simulation results shown in Tables 1-6 suggest that critical crown parameters exist for which theoretical crown deformation dramatically increases in a critical crown parameter range or transition region. For example, as shown in Tables 1-3, theoretical crown deformation dramatically increases in a crown radius of curvature range of 127 mm to 76.2 mm, a crown span range of 90 mm to 60 mm, and a crown thickness range of 0.6 mm to 0.55 mm. In contrast, parameters such as indenter radius, indenter drop height, crown material yield strength, and crown material elastic modulus do not exhibit similar dramatic transitions.

As shown in Table 3, a transition to greatly increased theoretical permanent crown deformation occurs over a crown thickness range of 0.58 mm to 0.57 mm. For example, for crown thicknesses of 0.58 mm and 0.57 mm, theoretical permanent crown deformations are 0.53 mm and 8.87 mm, respectively. The effect of crown thickness is complex as crown thicknesses above this transition range may also result in increased theoretical crown deformations. For example, as shown in Table 3, a crown thickness greater than 0.8 mm results in a higher theoretical crown deformation than that for a crown thickness of 0.6 mm.

Figure 11:
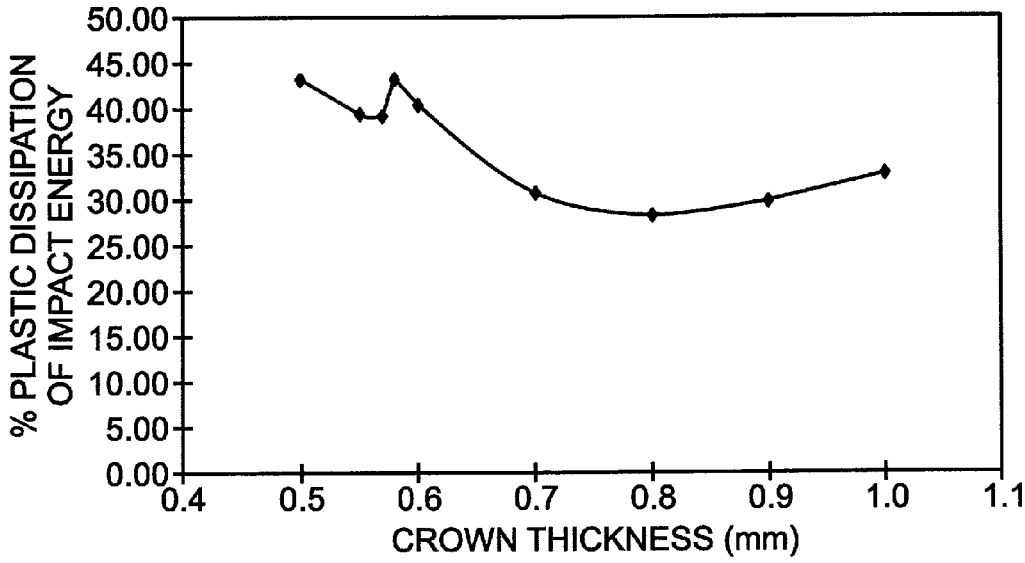
FIG. 11 a plot of a percentage of plastic dissipation as a function of crown thickness.

This crown thickness transition region effect can also be predicted by analyzing the "percentage of plastic dissipation," defined as the percent of impact energy dissipated in plastic deformation of the crown. The percentage of plastic dissipation as a function of crown thickness is shown in FIG. 11, wherein other simulation parameters are equivalent to the values used in Table 3. Note that the percentage of plastic dissipation for a crown thickness of 0.58 mm is about 44% while the percentage of plastic dissipation for a crown thickness of 0.57 mm is about 39%. The thinner 0.57 mm crown dissipates less impact energy than the thicker 0.58 mm crown, but produces more significant theoretical deformation.

Figure 12A:
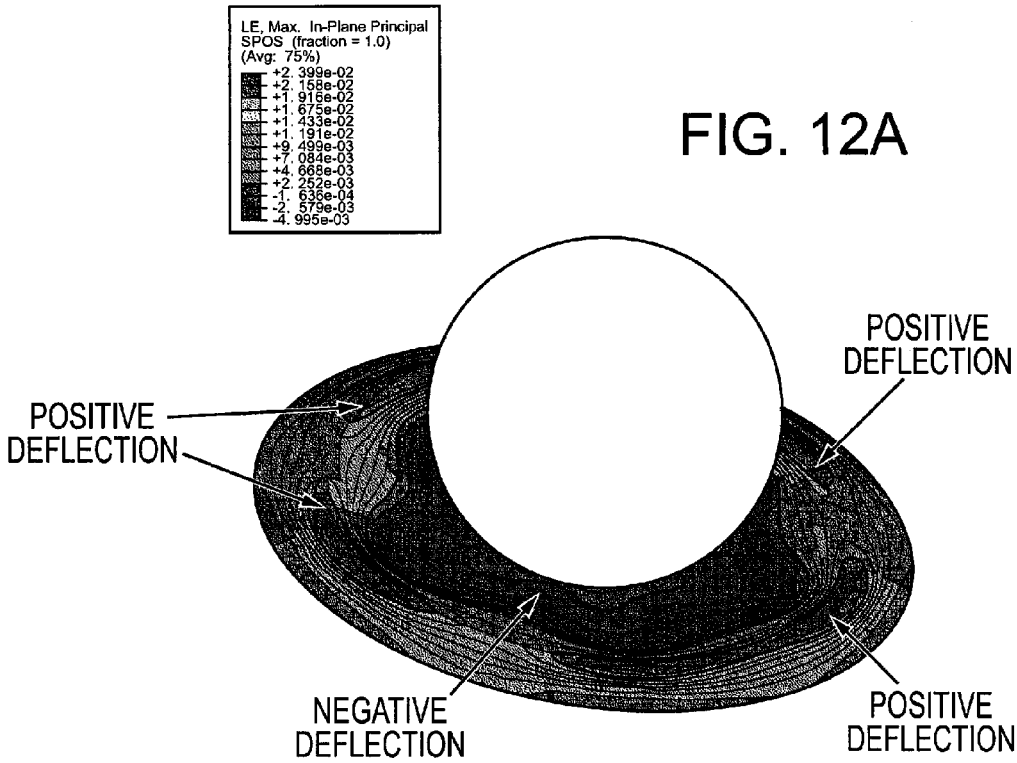
FIG. 12A is a graphical representation of a portion of a crown with a thickness of 0.57 mm at 4 ms after impact with a blunt indenter.
Figure 12B:
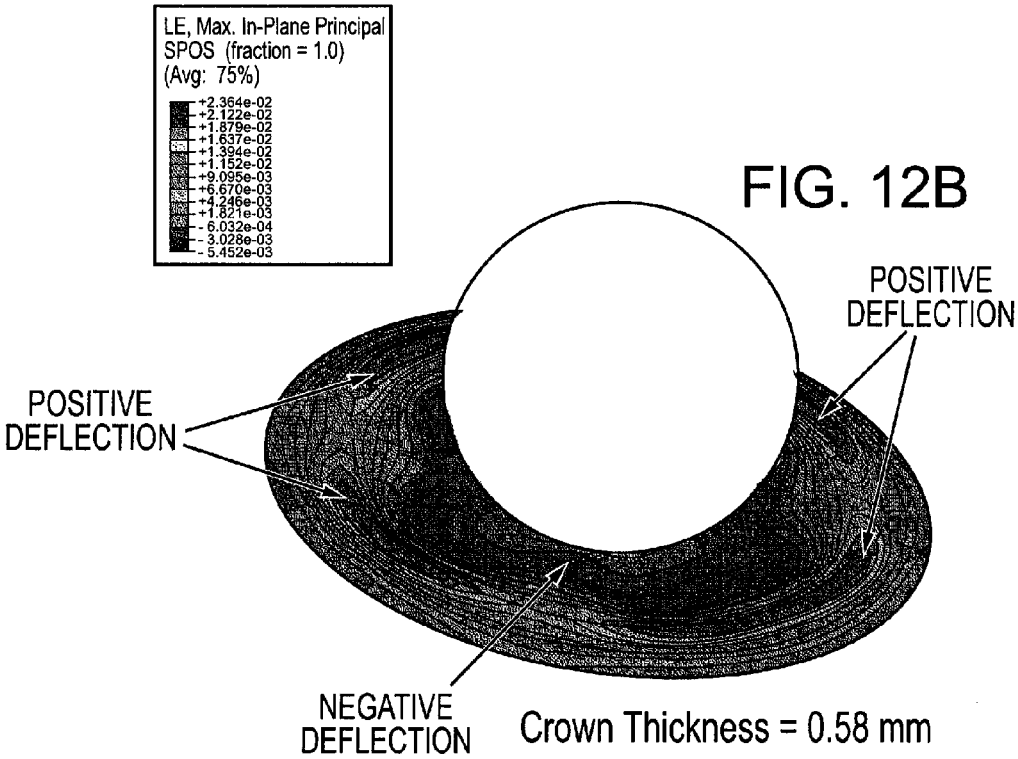
FIG. 12B is a graphical representation of a portion of a crown with a thickness of 0.58 mm at 4 ms after impact with a blunt indenter.

A closer examination of the numerical analysis results suggests that a typical impact deformation process may be divided into three post impact stages. A first stage may be characterized by predominantly elastic deformation around the impact location with local strain levels generally below the elastic limit. FIGS. 12A-12B are graphical representations of a portion of a crown 1202 at 4 ms after impact with a blunt indenter 1204 for 0.57 mm and 0.58 mm crown thicknesses, respectively. Crown span, radius of curvature, modulus of elasticity, and yield strength, and indenter drop height and radius correspond to the base model conditions in Table 3. The portion of the crown shown in FIGS. 12A-12B is shaded based on associated in-plane strain. Regions of positive and negative in-plane strain have been indicated. In both FIGS. 12A and 12B, dark regions surrounding an indenter 1204 correspond to elastic deformation. As shown in FIGS. 12A-12B, the 0.57 mm thick crown behaves very similarly to the 0.58 mm thick crown at this first post impact stage.

Figure 13A:
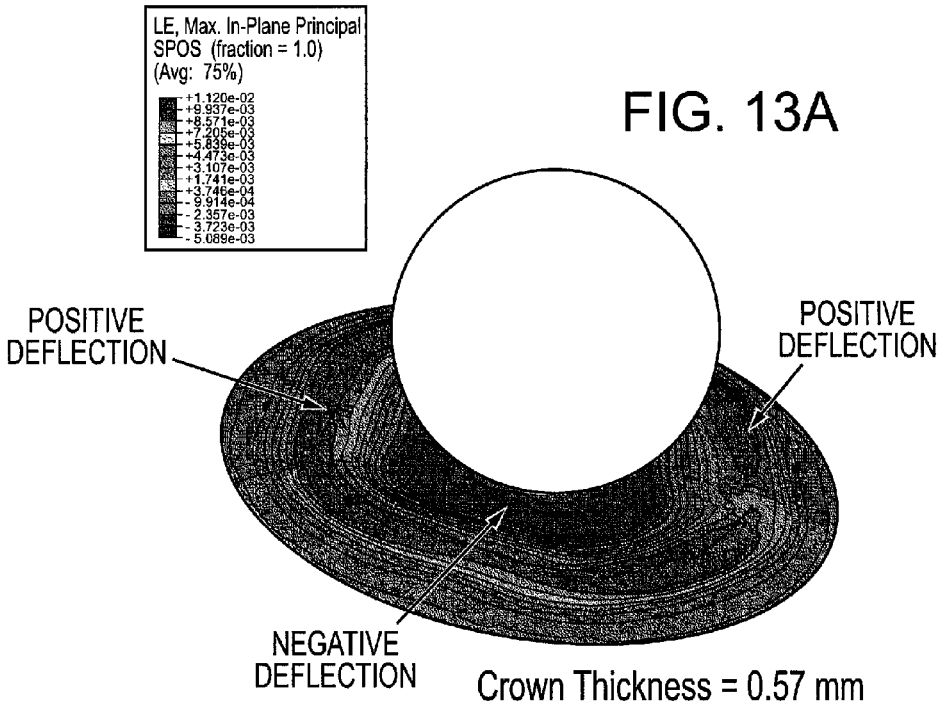
FIG. 13A is a graphical representation of a portion of a crown with a thickness of 0.57 mm at 7 ms after impact with a blunt indenter.
Figure 13B:
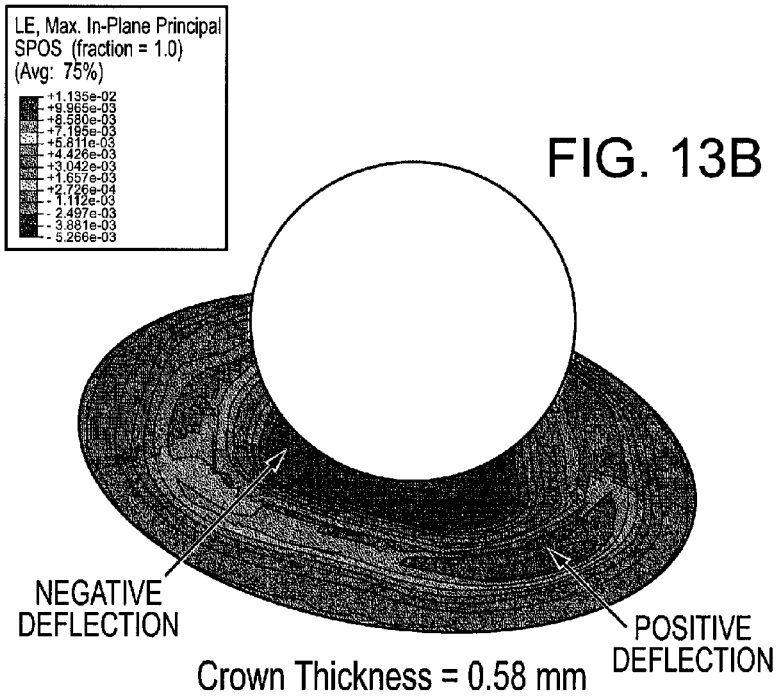
FIG. 13B is a graphical representation of a portion of a crown with a thickness of 0.58 mm at 7 ms after impact with a blunt indenter.

A second stage after impact may be characterized by the formation of a high stress/strain region on the crown surrounding and positioned away from the impact location. Local strain levels in such regions may exceed the elastic limit of the crown material, typically resulting in permanent local plastic deformation. FIGS. 13A-13B are graphical representations of a portion of a crown at this stage for 0.57 mm and 0.58 mm crown thicknesses, respectively, at 7 ms after impact. In FIG. 13A, a dark, ring-shaped region 1206 around the indenter 1204 is associated with a positive in-plane strain and corresponds to permanent local plastic deformation of the crown. The crown having a thickness of 0.58 mm behaves similarly to the crown having a thickness of 0.57 mm, however, strain levels in the 0.58 mm thick crown are slightly lower. The local strain levels in the 0.58 mm crown generally do not exceed the elastic limit. As shown in FIG. 13B, the positive in-plane strain of ring-shaped region 1208 is slightly less than that of region 1206.

Figure 14A:
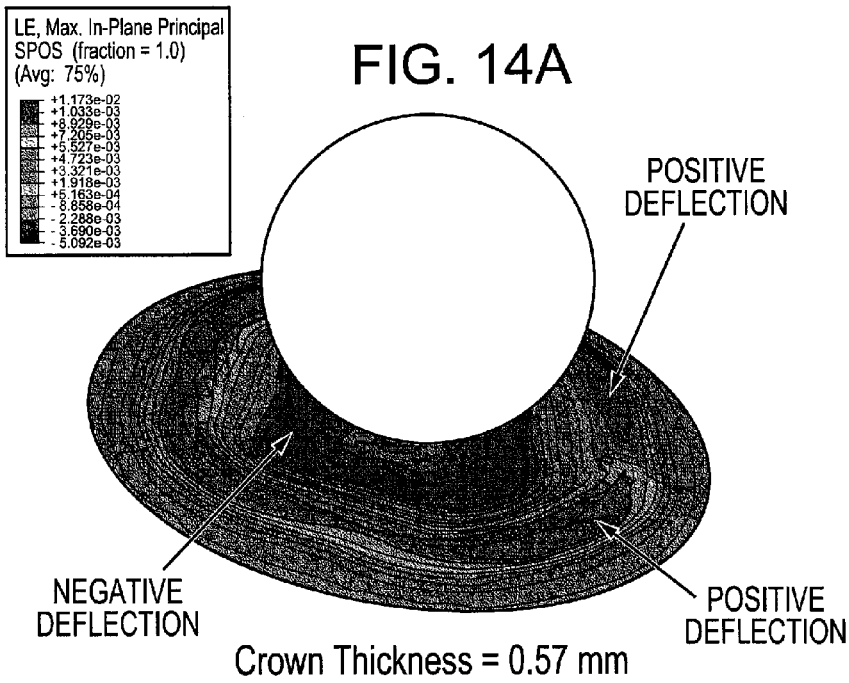
FIG. 14A is a graphical representation of a portion of a crown with a thickness of 0.57 mm at 8 ms after impact with a blunt indenter.
Figure 14B:
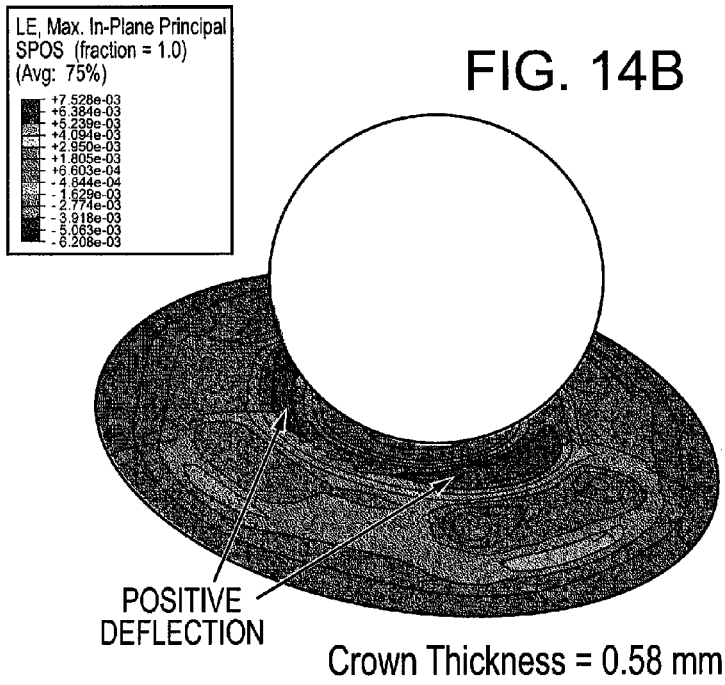
FIG. 14B is a graphical representation of a portion of a crown with a thickness of 0.58 mm at 8 ms after impact with a blunt indenter.
Figure 15A:
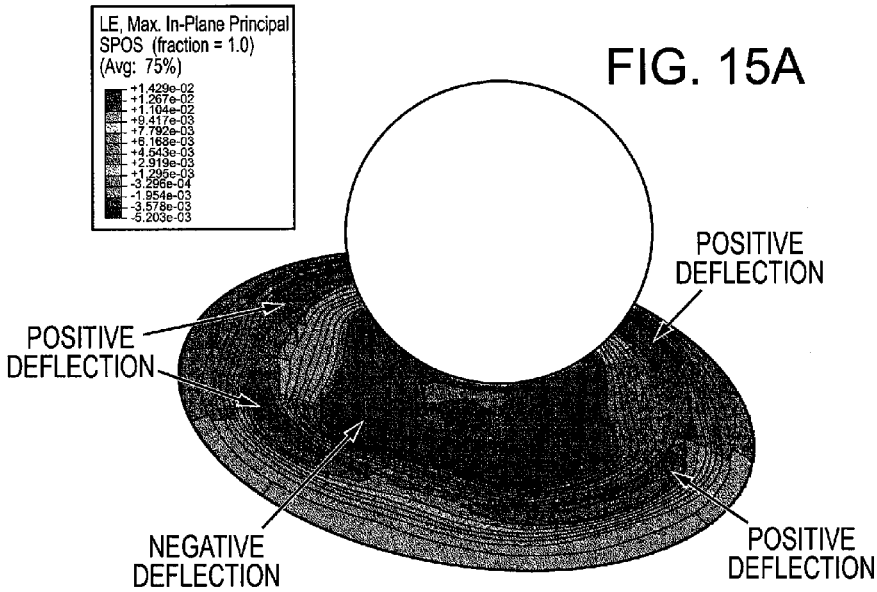
FIG. 15A is a graphical representation of a portion of a crown with a thickness of 0.57 mm at 10 ms after impact with a blunt indenter.
Figure 15B:
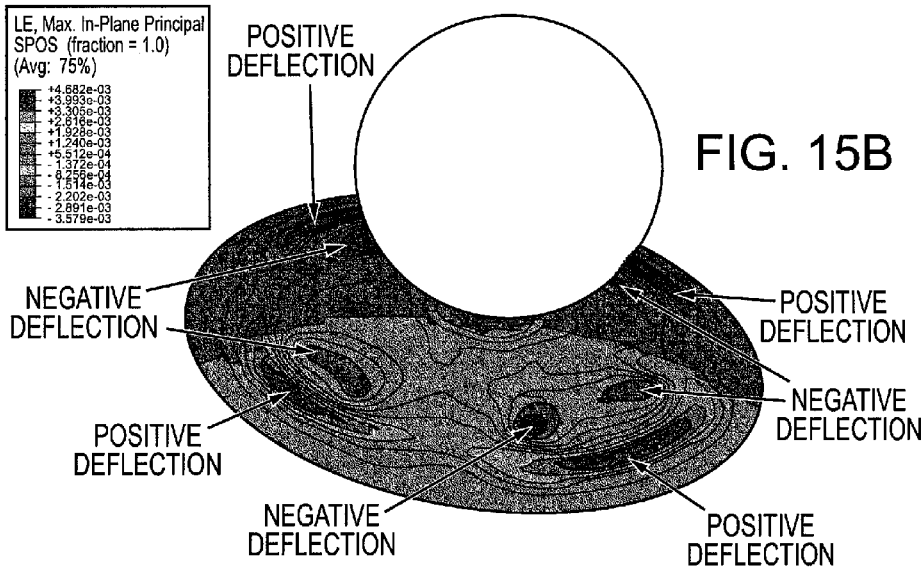
FIG. 15B is a graphical representation of a portion of a crown with a thickness of 0.58 mm at 10 ms after impact with a blunt indenter.

A third stage after impact is characterized by spring-back of the crown at the impact location. Depending on the extent of the plastic deformation in stage two, a portion of the deformed crown springs back to its original position. The remaining portion of the deformed crown remains permanently deformed, resulting in a dent. FIGS. 14A-14B are graphical representations of this stage for 0.57 mm and 0.58 mm crown thicknesses, respectively, at 8 ms after impact. FIGS. 15A-15B are graphical representations of this stage for 0.57 mm and 0.58 mm crown thicknesses, respectively, at 10 ms after impact. A dark region 1210 in FIG. 15A indicates permanent crown deformation. As shown in FIGS. 15A-15B, a crown thickness of 0.57 mm results in a much higher permanent theoretical crown deformation than is predicted for a crown thickness of 0.58 mm. Conversely, for a crown thickness of 0.58 mm, the majority of the deformed area is predicted to spring back, whereas a crown with a thickness of 0.57 mm exhibits significantly less spring-back, on the order of a seventeen-fold decrease compared to a crown with a thickness of 0.58 mm. Hence, the predicted spring-back results for crown thicknesses of 0.58 mm and 0.57 mm vary significantly, although the crown thickness difference is a seemingly insignificant 0.01 mm.

Figure 16:
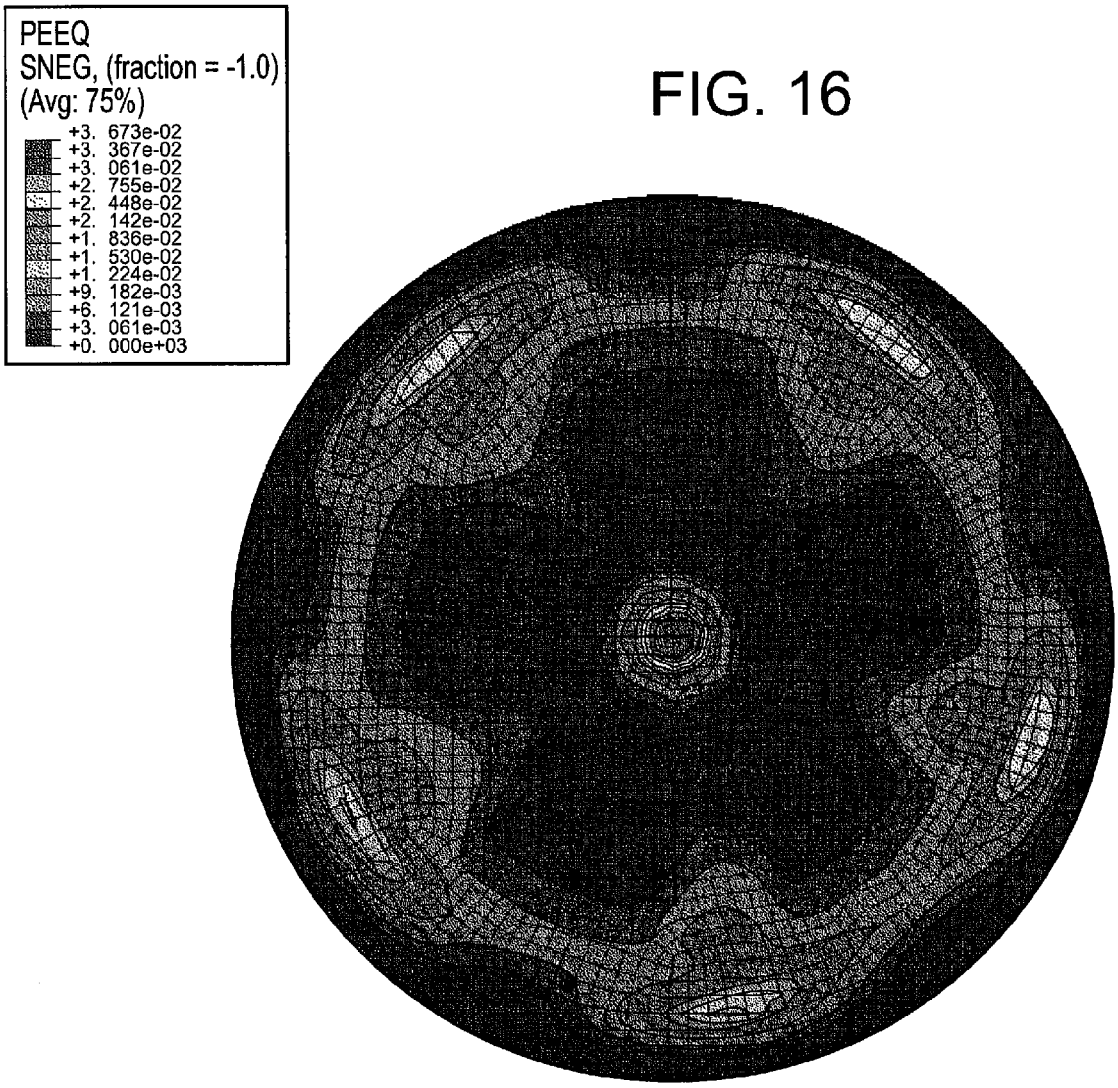
FIG. 16 is a graphical representation of permanent crown deformation in a portion of a crown with a thickness of 0.57 mm.

FIG. 16 illustrates theoretical in-plane strain in a 0.57 mm thick crown at 8 ms after impact with the indenter. The portion of the crown 1600 shown in FIG. 16 is divided into a plurality of surface elements that are shaded based on magnitudes of the associated in-plane strain. Surface elements associated with a central impact region 1602 and perimeter regions 1604-1608 are associated with in-plane strains greater than about 1.13%. Strains in the regions 1604-1608 are associated with permanent crown deformations that prevent the impact region 1602 from returning to its original shape. As shown in FIG. 16, the perimeter regions 1604-1608 are situated at periodic angles about the impact region 1602.

Figure 17:
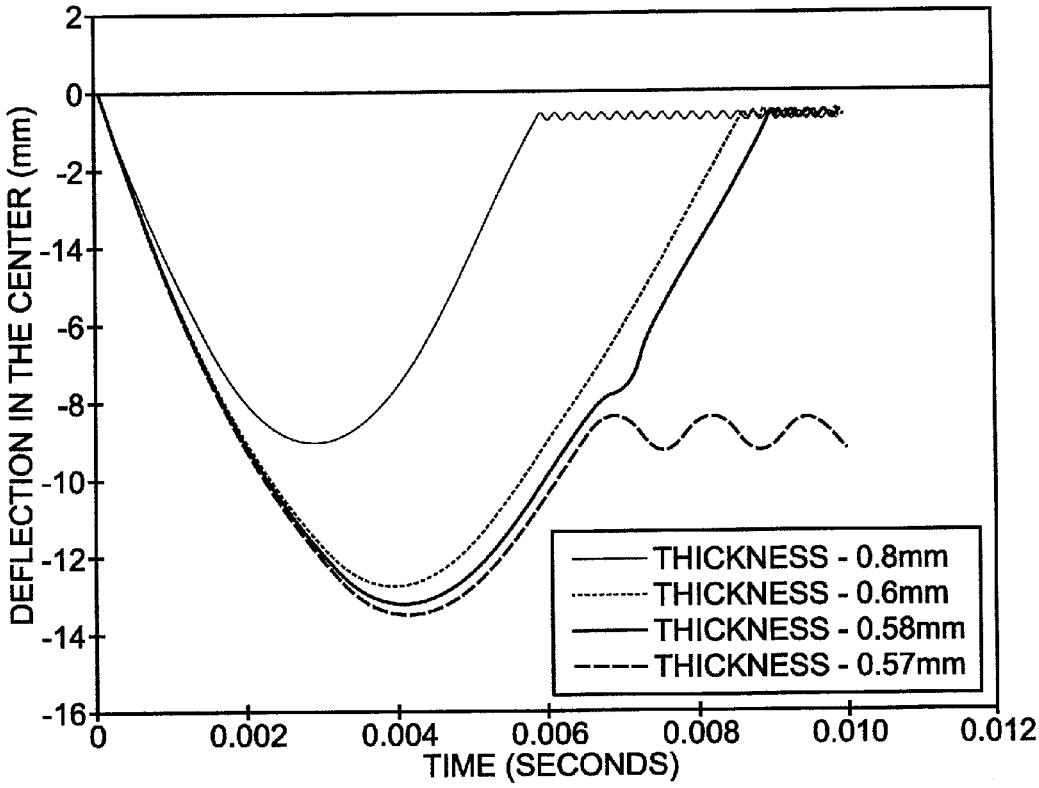
FIG. 17 is a plot of crown deflection at a center of impact versus time after impact for four different values of crown thickness.

Theoretical deformation of an impact center is graphed in FIG. 17 as a function of time after impact for crowns with four different thicknesses. For crown thicknesses of 0.6 mm and 0.8 mm, the crown material at the impact center springs back to substantially the original pre-impact position. For a 0.58 mm crown thickness, the crown material at the impact center "hesitates" at 7 ms but eventually returns to substantially its original pre-impact position. However, a 0.57 mm thick crown departs from initial spring-back motion at 7 ms after impact, and remains permanently deformed.

Buckling Theory

Column buckling theory may be used to illustrate the theoretical impact analysis described above. For a given column, the critical buckling load ($P_{cr}$) can be calculated using the following equation:

$$P_{cr}=(K^2\pi^2EI)/1^2, \quad (4)$$

wherein (E) is a modulus of elasticity of the column material, (I) is an area moment of inertia, (1) is a column length, and (K) is a loading parameter constant determined by a degree of freedom at the column ends. The critical buckling load ($P_{cr}$) can be estimated based on equilibrium of bending moments of the deformed shape according to the following equation:

$$M+P\delta=0, \quad (5)$$

wherein (M) is a restoring bending moment in the column, (P) is an axial load, and (δ) is a lateral deflection of the column. The restoring bending moment (M) is a function of modulus of elasticity (E), area moment of inertia (I), and lateral deflection (δ).

For all axial loads (P) less than the critical buckling load ($P_{cr}$), there is no lateral deflection (δ) of the column. When the axial load (P) is equivalent to the critical buckling load ($P_{cr}$), a state of equilibrium exists and a finite amount of lateral deflection (δ) of the column may result. When the axial load (P) is greater than the critical buckling load ($P_{cr}$), instability occurs and lateral deflection (6) of the column increases indefinitely, resulting in structural failure of the column. Note that while the critical buckling load ($P_{cr}$) is dependent on the modulus of elasticity (E), the area moment of inertia (I), column length (1), and loading parameter constant (K), the critical buckling load is independent of the strength of the column material.

Column buckling theory provides a simplified framework for understanding crown deformations and dents, but does not necessarily fully correlate with theoretical crown dent predictions discussed above. For a buckling column, the critical load (or deflection) is the result of a balance between the restoring effect of the restoring bending moment in the column (M) and the buckling effect of the axial load (i.e., P δ). As applied to the formation of crown dents, there exists a combination of parameters (e.g., crown thickness, crown span, crown radius of curvature) such that below a critical value of any one parameter, the restoring effect is typically insufficient to compensate for the deformation due to the applied load. This critical value may occur simultaneously with a sudden change in plastic dissipation (as shown in FIG. 11) and a concentration of plastic strain energy at discrete locations surrounding the impact point (as shown in FIGS. 12-16).

Experimental Testing

Crown response to impacts with other objects can be experimentally characterized using so-called impact tests. An impact test generally comprises dropping a test object of a predetermined mass, shape, and size from a selected height onto a golf club crown. Alternatively, the test object and/or the club head or crown can be accelerated to predetermined speeds so that the test object and crown collide with a predetermined relative impact speed.

In a typical example, an impact test is conveniently implemented as a "ball drop test" in which a ball is dropped onto the crown of a golf club head at least one impact location. For example, in the standard ball drop test, a steel ball with a diameter of about 48 mm is dropped from a height of about 1.3 m onto the crown of a golf club head at the seven impact locations shown in FIG. 18. Any resulting dents or permanent crown deformations can be measured and dent diameters at different impact locations may be averaged to determine a typical or average dent diameter. A ball drop test may be used to determine crown deformation as a function of crown span, curvature, thickness, or other crown parameter and to determine a critical thickness, span, curvature, or volume.

In general, typical permanent crown deformations are approximately circular and can be characterized based on a deformation diameter and depth. Typically, a depth that is about one half of a maximum deformation depth is used to determine a deformation diameter. In other examples, deformations have oval, elliptical, or other shapes and can be characterized by directional diameters based on deformation distances along one or more axes, or an effective diameter can be determined corresponding to a circular deformation having substantially the same deformation area. Deformation diameters can be estimated based on depths that are about 5%, 10%, or 25% of a maximum deformation depth, or can be based on a visual appearance. Crown deformations are generally measured or estimated based on impacts with a crown that is secured to a club head skirt and striking face so as to form a substantially complete wood-type golf club head. Typically, the wood-type golf head is formed from a metallic material.

Impact tests were performed on three different wood-type golf club configurations, Test Club Configurations A, B, and C. Details of these club configurations are summarized in Table 7. All Test Club Configurations were made of a material having a yield strength of 135 Ksi and a modulus of elasticity of 16 Msi. Several different samples of each configuration were tested, each sample having a different crown thickness.

TABLE 7

Test Club Configurations used in experimental crown impact tests.

| Test Club Configuration | Crown Surface Area ($mm^2$) | Front-to-Back Radius of Curvature (mm) | Toe-to-Heel Radius of Curvature (mm) | Equivalent Crown Span (mm) |
|---|---|---|---|---|
| A | 10043 | 85.3 | 94.5 | 113 |
| B | 8742 | 79.8 | 88.1 | 105.5 |
| C | 9939 | 85.6 | 91.8 | 112.5 |

Crown surface area (A) is defined as the total surface area of the crown as measured on an outer surface of the club head. An equivalent crown span ($S_{eq}$) is calculated by the following equation:

$$S_{eq}=(A/\pi)^{0.5}\times 2. \quad (6)$$

Figure 19:
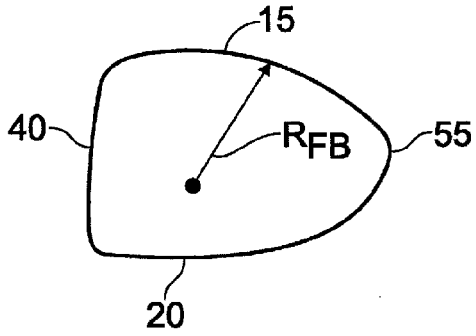
FIG. 19 is a cross-sectional view of a wood-type golf club head body indicating a crown front-to-back radius of curvature.
Figure 20:
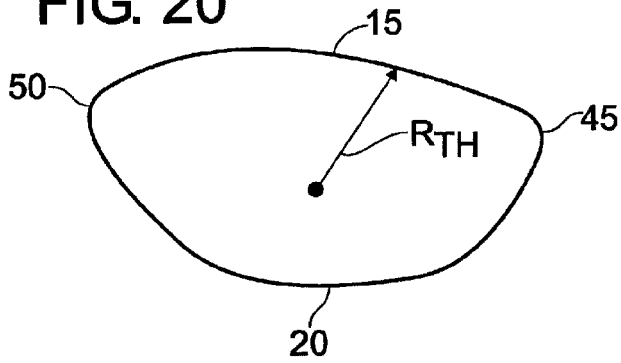
FIG. 20 is a cross-sectional view of a wood-type golf club head body indicating a crown toe-to-heel radius of curvature.

As shown in FIG. 19, a crown front-to-back radius of curvature ($R_{FB}$) is defined as an average radius of curvature of the crown measured along a plane defined by the club origin y-axis 75 and the club origin z-axis 65. As shown in FIG. 20, a crown toe-to-heel radius of curvature ($R_{TH}$) is defined as an average radius of curvature of the crown measured along a plane situated parallel to a plane defined by the club origin x-axis 70 and the club origin z-axis 65 and approximately halfway between the forward most and rear most points on the surface of the body 10 (i.e., at a distance equal to approximately half the maximum depth (D) from the forward most point on the surface of the body 10).

Figure 18:
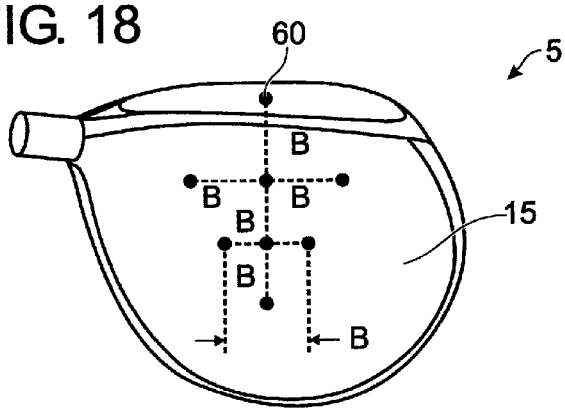
FIG. 18 is a top perspective view of a wood-type golf club head with six crown impact locations.

Experimental tests performed on Test Club Configurations A, B, and C involved the standard ball drop test. The standard ball drop tests were performed by dropping a 48 mm diameter steel ball from a height of 1.3 meters onto the crown of each club head. Seven drops were made, one drop at each of the seven crown impact locations depicted in FIG. 18. The seven impact locations were distributed across the crown with reference to the club head origin 60 as shown in FIG. 18, wherein a separation distance (B) was equal to approximately 25 mm. The crown thickness and experimental crown deformation, defined as the average dent diameter, were recorded for each impact location. The

TABLE 8

Experimental crown deformations as a function of crown thickness for Test Club Configuration A. Approximately 80% of each tested crown had the indicated crown thickness.

| Test Sample | Crown Thickness | Experimental Deformation | Ratio of Dent Area to Crown Surface Area |
|---|---|---|---|
| 1 | 0.500 mm | 32 mm | 0.080 |
| 2 | 0.580 mm | 6.5 mm | 0.0033 |
| 3 | 0.650 mm | 8.0 mm | 0.0050 |
| 4 | 0.674 mm | 5.6 mm | 0.0025 |
| 5 | 0.831 mm | 12.7 mm | 0.013 |
| 6 | 0.893 mm | 10.8 mm | 0.0091 |

TABLE 9

Experimental crown deformations as a function of crown thickness for Test Club Configuration B. Approximately 85% of each tested crown had the indicated crown thickness.

| Test Sample | Crown Thickness | Experimental Deformation | Ratio of Dent Area to Crown Surface Area |
|---|---|---|---|
| 1 | 0.460 mm | 23.8 mm | 0.051 |
| 2 | 0.534 mm | 26.0 mm | 0.061 |
| 3 | 0.849 mm | 11.2 mm | 0.011 |
| 4 | 0.883 mm | 9.8 mm | 0.0086 |

TABLE 10

Experimental crown deformations as a function of crown thickness for Test Club Configuration C. Approximately 85% of each tested crown had the indicated crown thickness

| Test Sample | Crown Thickness | Experimental Deformation | Ratio of Dent Area to Crown Surface Area |
|---|---|---|---|
| 1 | 0.571 mm | 26.2 mm | 0.054 |
| 2 | 0.640 mm | 7.7 mm | 0.0047 |
| 3 | 0.650 mm | 7.0 mm | 0.0039 |
| 4 | 0.879 mm | 11.7 mm | 0.011 |
| 5 | 0.888 mm | 14.0 mm | 0.015 |
| 6 | 0.919 mm | 11.8 mm | 0.011 |

experimental permanent crown deformation results for the standard ball drop tests performed on Test Clubs A, B, and C are shown in Tables 8-10. Note that experimental crown deformation is defined differently than theoretical crown deformation, which was defined as the maximum residual deflection in the z-direction after impact. Permanent deformation is also characterized in Tables 8-10 by a ratio of the dent area as determined from the average dent diameter to the crown surface area.

Although experimental crown deformation and theoretical crown deformation are defined differently, a comparison of the experimental and theoretical crown deformation values indicates that dent depth (as used in theoretical crown deformation) and dent diameter (as used in experimental crown deformation) can be correlated. For example, the experimental crown deformation values of Tables 8-10 also indicate that a critical crown thickness range, or transition region, exists across which significantly increased crown dent damage is observed. Such a transition region was also predicted based on the theoretical crown deformation data shown in Tables 1-6. The experiments also indicate that thicker crowns may be subject to more dent damage than thinner crowns, as was shown in the theoretical crown deformation data of Tables 1-6.

Discussion

The theoretical analysis and experimental results discussed above suggest that for a given combination of crown thickness, crown span, and crown radius of curvature of a wood-type golf club head, critical values exist for these parameters. Critical values typically represent a balance between bending or buckling of the crown due to dynamic loading (i.e., impact) and the crown's capacity to spring-back from the initial impact deformation, given a particular crown geometry.

For example, a critical thickness of a golf club crown is a thickness for which values of crown deformation diameter, deformation depth, deformation surface area, and other parameters associated with a size of a crown deformation are generally less than corresponding values for a substantially similar crown that is slightly thicker or thinner. Critical thickness is generally a function of crown span and of crown curvature in both front-to-back and heel-to-toe directions. Critical thickness can be conveniently estimated based on an impact test such as a ball drop test. For example, in a typical critical thickness ball drop test, a critical thickness is determined by varying the crown thickness while other crown parameters, such as span and curvature, are held constant. This type of ball drop test determines, for a predetermined crown radius of curvature and span, dent diameter or crown deformation as a function of crown thickness. The critical thickness is typically determined to be the crown thickness for which dent diameter and depth are substantially minimized in the ball drop test and for which slight increases or decreases in thickness produce larger deformations. Alternatively, critical thickness can be determined theoretically as corresponding to a sudden change in a percentage of plastic dissipation as a function of crown thickness.

A crown having a critical thickness is typically resistant to permanent crown deformation and can provide substantial re-distributable mass for club head design. A critical thickness range is a range of thicknesses that includes a critical thickness and thicknesses that are within about ±0.2 mm, ±0.1 mm, ±0.05 mm, ±0.02 mm, or ±0.01 mm of the critical thickness. A critical thickness range is not necessarily symmetric about the critical thickness. For example, a critical thickness range can be a range of −0.2 mm to +0.05 mm about a critical thickness, and other asymmetric ranges can be based on the symmetric range limits listed above. Golf club crowns having thicknesses within critical thickness ranges are referred to herein as having thicknesses that are equivalent to a critical thickness.

A critical crown volume is a crown volume associated with selected values of crown curvature, thickness, and span such that crown deformations are less than those for crowns having slightly different values of these parameters. A change in any one of crown curvature, thickness, and span associated with a critical crown volume generally results in a substantial increase in permanent crown deformation size as produced in an impact test such as a ball drop test. Golf club crowns having volumes associated with a range of critical crown volumes characterized by reduced deformations in response to impacts and based on one or more critical crown parameters such as thickness, curvature, span, or a ranges of these parameters are referred to herein as having volumes that are equivalent to a critical crown volume.

A critical span of a golf club crown is a crown span for which crown deformation is generally substantially less than for substantially similar crowns with slightly different spans. Golf club crowns having spans greater than a critical span are referred to herein as having spans that are equivalent to a critical span. Typically a critical span is associated with a deformation depth of no greater than about 3 mm, and for which deformation depth decreases by about 0.05, 0.1, or 0.2 mm for an increase of about 1 mm in crown span. A critical span may be determined by conducting a ball drop test in which the crown span is varied while the thickness and the radius of curvature are held constant.

A critical radius of curvature of a golf club crown is a crown radius of curvature for which crown deformation is generally substantially less than for substantially similar crowns with smaller radii of curvature. A critical crown radius of curvature can be a heel-to-toe, a front-to-back, or an average crown radius of curvature. Typically a critical radius of curvature is associated with a deformation depth of no greater than about 3 mm, and for which deformation depth decreases by about 0.4, 0.5, or 0.6 mm for an increase of about 1 mm in crown radius of curvature. Golf club crowns having radii of curvature less than a critical radius of curvature are referred to herein as having radii of curvature that are equivalent to a critical radius of curvature. A critical radius of curvature may be determined by conducting a ball drop test in which the radius of curvature is varied while the thickness and the span are held constant.

An impact resistant crown is a golf club crown that is resistant to permanent crown deformation. When subjected to an impact test, an impact resistant crown generally exhibits typical dent sizes that are acceptably small. For example, an average dent size as determined by a ball drop test may be deemed to be sufficiently small if such a dent does not detract substantially from the appearance or functionality of the golf club head. Generally, an average dent or deformation is acceptable if a ratio of a surface area associated with the deformation to a crown surface area is less than about 0.010, 0.006, 0.002, 0.001, 0.0005, or 0.0002, as determined by a ball drop test in which a steel ball with a diameter of about 48 mm is dropped from a height of about 1.3 m onto the crown. Resistance of a particular crown to deformation generally depends on, for example, crown span, crown thickness, or crown radii of curvature along toe-to-heel, front-to-back, or other directions.

While crown evaluations based on an impact test depend on, for example, test object mass, size, and relative impact speed, critical values determined based on impact tests tend to be surprisingly insensitive to exact impact test parameters. For example, as shown in Table 5 above, increasing drop height tends to increase dent size or permanent crown deformation but a doubling of drop height increases crown deformation only slightly, from about 0.62 mm to about 0.69 mm. For a test object having a diameter between 35.6 mm and 55.8 mm dropped from a height between 1 m and 2 m, typical dent diameters vary only by about 10%. Therefore, although ball drop tests (or other impact tests) performed under slightly different conditions of test object radius and drop height may result in the determination of slightly different typical or average dent diameters, such variability does not tend to significantly change estimated values of critical thickness, critical volume, or critical crown radius of curvature. For convenience in this disclosure, impact tests are based on ball drop heights (or associated equivalent test object/crown relative speeds) of between about 0.5 m and about 3 m and test objects having radii between about 15 mm and 50 mm.

First Club Head Example

In some embodiments, the crown, sole, skirt, and striking plate may be formed from one or more metallic materials using conventional casting techniques (e.g., centrifugal investment casting), cold forming, and/or forging. The metallic materials may be chosen from various steel alloys (e.g., carbon steels: 1020, 8620; stainless steels: 304, 410, PH alloys: 17-4, C450, C455) and/or titanium alloys (e.g., alpha/near alpha: 3-2.5, alpha-beta: 6-4, SP700, beta/near beta: 15-3-3-3, 10-2-3). Alternatively, the crown, sole, skirt, and striking plate may be formed from one or more composite materials, such as glass fiber reinforced polymers (GFRP), carbon fiber reinforced polymers (CFRP), metal matrix composites (MMC), and/or ceramic matrix composites (CMC). The crown, sole, and skirt of the golf club head may be formed as a unitary body, and the striking plate may be attached to the unitary body by various means, such as plasma welding, laser welding, or adhesive bonding.

In some embodiments, the crown may be formed such that about 60% to 100% of the crown has a thickness of less than about 0.65 mm; the crown surface area is between about 8000 $mm^2$ to about 11000 $mm^2$; the equivalent crown span is between about 90 mm to about 120 mm; the crown front-to-back radius of curvature ($R_{FB}$) is between about 60 mm to about 120 mm; the crown toe-to-heel radius of curvature ($R_{TH}$) is between about 60 mm to about 120 mm; and the crown is constructed from a material having a modulus of elasticity between about 13 Msi to about 20 Msi. More preferably, the crown may be formed such that about 70% to about 90% of the crown has a thickness of less than about 0.62 mm; the crown surface area is between about 8600 mm to about 10000 $mm^2$; the equivalent crown span is between about 95 mm to about 110 mm; the crown front-to-back radius of curvature ($R_{FB}$) is between about 70 mm to about 110 mm; the crown toe-to-heel radius of curvature ($R_{TH}$) is between about 70 mm to about 110 mm; and the crown is constructed from a material having a modulus of elasticity between about 14 Msi to about 18 Msi. Most preferably, the crown may be formed such that about 80% to 85% of the crown has a thickness of less than about 0.60 mm; the crown surface area is between about 8800 $mm^2$ to about 9200 $mm^2$; the equivalent crown span is between about 100 mm to about 105 mm; the crown front-to-back radius of curvature ($R_{FB}$) is between about 80 mm to about 100 mm; the crown toe-to-heel radius of curvature ($R_{TH}$) is between about 80 mm to about 100 mm; and the crown is constructed from a material having a modulus of elasticity between about 15 Msi to about 16 Msi.

In some embodiments, the club head may be formed such that at least about 50% of the skirt has a thickness of between about 0.65 mm to about 0.8 mm and at least about 50% of the sole has a thickness between about 0.85 mm to about 1.1 mm. More preferably, the club head may be formed such that at least about 60% of the skirt has a thickness of between about 0.65 mm to about 0.8 mm and at least about 55% of the sole has a thickness between about 0.85 mm to about 1.1 mm. Most preferably, the club head may be formed such that at least about 70% of the skirt has a thickness of between about 0.65 mm to about 0.8 mm and at least about 60% of the sole has a thickness between about 0.85 mm to about 1.1 mm.

In some embodiments, the total mass of the club head is between about 150 grams to about 300 grams; the volume of the club head is between about 300 $cm^3$ to about 500 $cm^3$; the moment of inertia about the $CG_x$-axis ($I_{CGx}$) is between about 300 $kg \cdot mm^2$ to about 450 $kg \cdot mm^2$; the moment of inertia about the $CG_z$-axis ($I_{CGz}$) is between about 400 $kg \cdot mm^2$ to about 700 $kg \cdot mm^2$; Delta-1 is between about 10 mm to about 30 mm; the center-of-gravity of the club head is located between about 0 mm to about 10 mm below a plane defined by the head origin x-axis 70 and the head origin y-axis 75; the head depth (D) is between about 70 mm to about 120 mm; the head height (H) is between about 50 mm to about 80 mm; and the head width (W) is between about 80 mm to about 130 mm. More preferably, the total mass of the club head is between about 170 grams to about 250 grams; the volume of the club head is between about 320 $cm^3$ to about 480 $cm^3$; the moment of inertia about the $CG_x$-axis ($I_{CGx}$) is between about 325 kg·mm$^2$ to about 425 kg·mm$^2$; the moment of inertia about the $CG_z$-axis ($I_{CGz}$) is between about 500 kg·mm$^2$ to about 600 kg·mm$^2$; Delta-1 is between about 15 mm to about 26 mm; the center-of-gravity of the club head is located between about 2 mm to about 8 mm below a plane defined by the head origin x-axis 70 and the head origin y-axis 75; the head depth (D) is between about 80 mm to about 110 mm; the head height (H) is between about 55 mm to about 75 mm; and the head width (W) is between about 90 mm to about 120 mm. Most preferably, the total mass of the club head is between about 190 grams to about 210 grams; the volume of the club head is between about 350 cm$^3$ to about 460 cm$^3$; the moment of inertia about the $CG_x$-axis ($I_{CGx}$) is between about 350 kg·mm$^2$ to about 400 kg·mm$^2$; the moment of inertia about the $CG_z$-axis ($I_{CGz}$) is between about 550 kg·mm$^2$ to about 600 kg·mm$^2$; Delta-1 is between about 18 mm to about 22 mm; the center-of-gravity of the club head is located between about 5 mm to about 7 mm below a plane defined by the head origin x-axis 70 and the head origin y-axis 75; the head depth (D) is between about 90 mm to about 100 mm; the head height (H) is between about 60 mm to about 70 mm; and the head width (W) is between about 100 mm to about 110 mm.

Second Club Head Example

In another embodiment, the crown, sole, and skirt of the golf club head are formed as a unitary body from Ti-6Al-4V alloy by means of centrifugal investment casting. The striking plate is formed from a cold rolled, Ti-6Al-4V sheet alloy and attached to the unitary body by means of plasma welding. The crown is formed such that about 81% of the crown has a thickness of about 0.6 mm or less and about 19% of the crown has a thickness greater than or equal to about 0.8 mm. The skirt is formed such that the skirt thickness is between about 0.6 mm and about 1.1 mm. The sole is formed such that the sole thickness is between about 0.8 mm and about 1.2 mm. The crown has a crown surface area (A) of about 9650 mm$^2$; an equivalent crown span ($S_{eq}$) of about 111 mm; a crown front-to-back radius of curvature ($R_{FB}$) between about 85 mm and about 90 mm; and a crown toe-to-heel radius of curvature ($R_{TH}$) between about 100 mm and about 120 mm. The golf club head has a total head mass of about 206 grams and defines a head volume of about 411 cm$^3$. The golf club head has a moment of inertia about the $CG_x$-axis ($I_{CGx}$) between about 219 kg·mm$^2$ and about 255 kg·mm$^2$; a moment of inertia about the $CG_z$-axis ($I_{CGz}$) between about 384 kg·mm$^2$ and about 391 kg·mm$^2$; a Delta-1 between about 14.9 mm and about 16.8 mm; and the center-of-gravity of the golf club head is located below a plane defined by the head origin x-axis 70 and the head origin y-axis 75. The golf club head has a head depth (D) of about 102 mm, a head height (H) of about 65.5 mm, and a head width (W) of about 116 mm.

Third Club Head Example

In another embodiment, the crown, sole, and skirt of the golf club head are formed as a unitary body from Ti-6Al-4V alloy by means of centrifugal investment casting. The striking plate is formed from cold rolled, Ti-6Al-4V alloy sheet and attached to the unitary body by means of plasma welding. The crown is formed such that about 82% of the crown has a thickness of about 0.6 mm or less and about 18% of the crown has a thickness greater than or equal to about 0.8 mm. The skirt is formed such that the skirt thickness is between about 0.6 mm and about 0.9 mm. The sole is formed such that the sole thickness is between about 0.8 mm and about 1.1 mm. The crown has a crown surface area (A) of about 10285 mm$^2$; an equivalent crown span ($S_{eq}$) of about 114 mm; a crown front-to-back radius of curvature ($R_{FB}$) between about 85 mm and about 90 mm; and a crown toe-to-heel radius of curvature ($R_{TH}$) between about 110 mm and about 120 mm. The golf club head has a total head mass of about 204 grams and defines a head volume of about 455 cm$^3$. The golf club head has a moment of inertia about the $CG_x$-axis ($I_{CGx}$) of about 259 kg·mm$^2$; a moment of inertia about the $CG_z$-axis ($I_{CGz}$) of about 416 kg·mm$^2$ to about 421 kg·mm$^2$; a Delta-1 of about 18.5 mm; and the center-of-gravity of the golf club head is located below a plane defined by the head origin x-axis 70 and the head origin y-axis 75. The golf club head has a head depth (D) of about 109 mm, a head height (H) of about 65.7 mm, and a head width (W) of about 115 mm.

In view of the many possible embodiments to which the disclosed principles may be applied, it should be recognized that the illustrated embodiments are only examples and should not be taken as limiting the scope of the disclosed claims. We claim all that comes within the scope and spirit of the appended claims.

We claim:

1. A wood-type golf club head, comprising:

a body including a striking plate positioned at a front portion of the golf club head, a sole positioned at a bottom portion of the golf club head, a crown positioned at an upper portion of the golf club head, and a skirt positioned around a periphery of the golf club head between the sole and the crown, wherein the sole, the crown, and the skirt of the golf club head are formed as a unitary cast body, and the striking plate is attached to an opening located at the front portion of the golf club head, wherein at least about 50% of the crown has a thickness that is less than or equal to 0.62 mm and greater than a critical thickness, the critical thickness being between 0.57 mm and 0.58 mm, and wherein the crown exhibits an average permanent crown deformation having an area less than about 0.7% of a crown surface area in response to a standard ball drop test, and wherein the crown includes an equivalent crown span between about 90 mm and about 120 mm; a crown front-to-back radius of curvature between about 60 mm and about 120 mm; and a crown toe-to-heel radius of curvature between about 60 mm and about 120 mm; and wherein the crown is constructed from a material having a modulus of elasticity between about 13 Msi and about 20 Msi.

2. The wood-type golf club head according to claim 1, wherein the crown has a surface area between about 8000 mm$^2$ and about 11000 mm$^2$.

3. The wood-type golf club head according to claim 2, wherein the crown has a surface area between about 8800 mm$^2$ and about 9200 mm$^2$.

4. The wood-type golf club head according to claim 1, wherein the average permanent crown deformation area is less than about 0.5% of the crown surface area.

5. The wood-type golf club head according to claim 1, wherein the average permanent crown deformation area is less than about 0.3% of the crown surface area.

6. The wood-type golf club head according to claim 1, wherein a moment of inertia about a club head center of gravity z-axis generally perpendicular to the ground with the club head at an address position is between about 400 kg·mm$^2$ and about 700 kg·mm$^2$.

7. The wood-type golf club head according to claim 6, wherein the moment of inertia about the club head center of gravity z-axis is between about 500 kg·mm$^2$ and about 600 kg·mm$^2$.

8. The wood-type golf club head according to claim 1, wherein the golf club head has a head depth between about 70 mm and about 120 mm.

9. The wood-type golf club head according to claim 1, wherein the golf club head has a head height between about 50 mm and about 80 mm.

10. The wood-type golf club head according to claim 1, wherein the golf club head has a head width between about 80 mm and about 130 mm.

11. A golf club head comprising:

a body including a striking plate positioned at a front portion of the golf club head, a sole positioned at a bottom portion of the golf club head, a crown positioned at an upper portion of the golf club head, and a skirt positioned around a periphery of the golf club head between the sole and the crown, wherein the sole, the crown, and the skirt of the golf club head are formed as a unitary cast body, and the striking plate is attached to an opening located at the front portion of the golf club head, the sole being substantially flat and the crown being substantially curved, wherein the crown includes an equivalent crown span between about 90 mm and about 120 mm; a crown front-to-back radius of curvature between about 60 mm and about 120 mm; and a crown toe-to-heel radius of curvature between about 60 mm and about 120 mm; and wherein at least the crown is constructed from a material having a modulus of elasticity between about 13 Msi and about 20 Msi;

wherein a total mass of the golf club head is between about 150 grams and about 300 grams;

wherein a volume of the club head is between about 300 $cm^3$ and about 500 $cm^3$;

wherein a head depth is between about 70 mm and about 120 mm;

wherein a head height is between about 50 mm and about 80 mm;

wherein a head width is between about 80 mm and about 130 mm;

wherein a head origin is defined at the center of the striking plate, the head origin defining the location of a coordinate system including:

a head origin x-axis being tangential to the face and parallel to a ground plane;

a head origin y-axis being orthogonal to the head origin x-axis and parallel to the ground plane; and a head origin z-axis being orthogonal to both the head origin x-axis and the head origin y-axis;

wherein the center-of-gravity (CG) of the club head is located between about 0 mm and about 10 mm below a plane defined by the head origin x-axis and the head origin y-axis;

wherein the CG defines the origin of a coordinate system including a CGx-axis parallel to the head origin x-axis and passing through the CG, a CGy-axis parallel to the head origin y-axis and passing through the CG, and a CGz-axis parallel to the head origin z-axis and passing through the CG, wherein Delta-1 is defined as a distance measured along the CGy-axis between a plane formed by the CGx-axis and the CGz-axis and a plane passing through the shaft axis and generally parallel to the CGz-axis;

wherein Delta-1 is between about 10 mm and about 30 mm;

wherein a moment of inertia about the CGx-axis ($I_{CGx}$) is between about 300 $kg \cdot mm^2$ and about 450 $kg \cdot mm^2$; and wherein a moment of inertia about the CGz-axis ($I_{CGZ}$) is between about 400 $kg \cdot mm^2$ and about 700 $kg \cdot mm^2$.

* * * * *